US008178276B2

(12) United States Patent
Uchinokura et al.

(10) Patent No.: US 8,178,276 B2
(45) Date of Patent: May 15, 2012

(54) METHOD OF MANUFACTURING TONER

(75) Inventors: Osamu Uchinokura, Mishima (JP); Akinori Saitoh, Numazu (JP); Junichi Awamura, Numazu (JP); Masahide Yamada, Numazu (JP); Hiroshi Yamada, Numazu (JP)

(73) Assignee: Ricoh Company Limited, Tokyo (JP)

( * ) Notice: Subject to any disclaimer, the term of this patent is extended or adjusted under 35 U.S.C. 154(b) by 521 days.

(21) Appl. No.: 12/399,636

(22) Filed: Mar. 6, 2009

(65) Prior Publication Data

US 2009/0226836 A1 Sep. 10, 2009

(30) Foreign Application Priority Data

Mar. 7, 2008 (JP) ..... 2008-058705
Mar. 18, 2008 (JP) ..... 2008-068885
Mar. 18, 2008 (JP) ..... 2008-068886

(51) Int. Cl.
*G03G 5/00* (2006.01)
*B07B 7/08* (2006.01)

(52) U.S. Cl. ..... 430/137.2; 430/110.4; 430/111.4; 430/137.14; 430/137.15; 430/137.18; 209/139.2; 209/148; 209/152

(58) Field of Classification Search ..... 430/110.4, 430/111.4, 137.14, 137.15, 137.8, 137.18; 209/152, 139.2, 148
See application file for complete search history.

(56) References Cited

U.S. PATENT DOCUMENTS 6,360,068 B1 3/2002 Kinoshita et al.
6,416,914 B1 7/2002 Nakamura et al.
6,432,589 B1 8/2002 Uchinokura et al.
6,432,590 B1 8/2002 Ueda et al.
6,479,204 B1 11/2002 Uchinokura et al.
6,503,676 B2 1/2003 Yamashita et al.
6,641,969 B2 11/2003 Uchinokura et al.
6,733,939 B2 5/2004 Nanya et al.
6,737,210 B2 5/2004 Uchinokura et al.
6,756,175 B2 6/2004 Emoto et al.
6,787,280 B2 9/2004 Yamashita et al.
6,818,370 B2 11/2004 Uchinokura et al.
6,846,604 B2 1/2005 Emoto et al.
6,849,369 B2 2/2005 Yagi et al.
6,852,462 B2 2/2005 Emoto et al.
6,855,468 B1 2/2005 Yamamoto et al.
6,916,587 B2 7/2005 Fushimi et al.
6,936,390 B2 8/2005 Nanya et al.
7,083,890 B2 8/2006 Emoto et al.

(Continued)

FOREIGN PATENT DOCUMENTS

JP 6-19201 1/1994

(Continued)

OTHER PUBLICATIONS

U.S. Appl. No. 12/091,301, filed Apr. 24, 2008, Hideki Sugiura, et al.

*Primary Examiner* — Thorl Chea

(74) *Attorney, Agent, or Firm* — Oblon, Spivak, McClelland, Maier & Neustadt, L.L.P.

(57) ABSTRACT

A method of manufacturing a toner including granulating mother toner particles in an aqueous medium to obtain a slurry containing the mother toner particles and adjusting a size distribution of the mother toner particles by screening coarse mother toner particles from the slurry with a screen to obtain the toner containing mother toner particulates.

13 Claims, 1 Drawing Sheet

U.S. PATENT DOCUMENTS

| | | | | |
|---|---|---|---|---|
| 7,129,013 | B2 | 10/2006 | Higuchi et al. | |
| 7,258,959 | B2 | 8/2007 | Nakayama et al. | |
| 7,300,736 | B2 | 11/2007 | Fushimi et al. | |
| 7,303,847 | B2 | 12/2007 | Tomita et al. | |
| 7,318,989 | B2 | 1/2008 | Kotsugai et al. | |
| 7,348,117 | B2 | 3/2008 | Inoue et al. | |
| 7,348,121 | B2 | 3/2008 | Inoue et al. | |
| 7,368,213 | B2 | 5/2008 | Nakayama et al. | |
| 7,374,848 | B2 | 5/2008 | Matsuoka et al. | |
| 7,374,851 | B2 | 5/2008 | Nakayama et al. | |
| 7,396,630 | B2 | 7/2008 | Watanabe et al. | |
| 7,419,756 | B2 | 9/2008 | Yamashita et al. | |
| 7,429,442 | B2 | 9/2008 | Honda et al. | |
| 7,435,521 | B2 | 10/2008 | Yagi et al. | |
| 7,437,111 | B2 | 10/2008 | Yamada et al. | |
| 7,442,484 | B2 | 10/2008 | Uchinokura et al. | |
| 7,449,273 | B2 | 11/2008 | Ohki et al. | |
| 7,455,942 | B2 | 11/2008 | Nagatomo et al. | |
| 7,459,255 | B2 | 12/2008 | Tanaka et al. | |
| 7,473,508 | B2 | 1/2009 | Higuchi et al. | |
| 7,488,564 | B2 | 2/2009 | Tanaka et al. | |
| 2003/0096185 | A1 | 5/2003 | Yamashita et al. | |
| 2004/0131961 | A1 | 7/2004 | Watanabe et al. | |
| 2004/0137357 | A1* | 7/2004 | Bartel et al. | 430/137.14 |
| 2005/0089786 | A1 | 4/2005 | Sugiura et al. | |
| 2005/0112488 | A1 | 5/2005 | Yamada et al. | |
| 2005/0164112 | A1 | 7/2005 | Ohki et al. | |
| 2005/0208408 | A1 | 9/2005 | Uchinokura et al. | |
| 2006/0024097 | A1 | 2/2006 | Yamada et al. | |
| 2006/0029433 | A1 | 2/2006 | Saito et al. | |
| 2006/0046178 | A1* | 3/2006 | Akiyama et al. | 430/108.23 |
| 2006/0057488 | A1 | 3/2006 | Inoue et al. | |
| 2006/0068312 | A1 | 3/2006 | Yamashita et al. | |
| 2006/0160011 | A1 | 7/2006 | Inoue et al. | |
| 2006/0210903 | A1 | 9/2006 | Ohki et al. | |
| 2006/0240349 | A1 | 10/2006 | Watanabe et al. | |
| 2006/0251979 | A1 | 11/2006 | Watanabe et al. | |
| 2007/0054210 | A1 | 3/2007 | Ohki et al. | |
| 2007/0059626 | A1 | 3/2007 | Inoue et al. | |
| 2007/0134581 | A1 | 6/2007 | Uchinokura et al. | |
| 2007/0218380 | A1 | 9/2007 | Uchinokura et al. | |
| 2007/0218381 | A1 | 9/2007 | Uchinokura et al. | |
| 2007/0218382 | A1 | 9/2007 | Emoto et al. | |
| 2007/0218389 | A1 | 9/2007 | Honda et al. | |
| 2007/0218391 | A1 | 9/2007 | Yamada et al. | |
| 2007/0218392 | A1 | 9/2007 | Yamada et al. | |
| 2007/0264035 | A1 | 11/2007 | Fushimi et al. | |
| 2008/0014527 | A1 | 1/2008 | Kotsugai et al. | |
| 2008/0069616 | A1 | 3/2008 | Kojima et al. | |
| 2008/0070144 | A1 | 3/2008 | Nagatomo et al. | |
| 2008/0070148 | A1 | 3/2008 | Awamura et al. | |
| 2008/0076055 | A1 | 3/2008 | Sawada et al. | |
| 2008/0090165 | A1 | 4/2008 | Yamada et al. | |
| 2008/0213682 | A1 | 9/2008 | Saitoh et al. | |
| 2008/0227000 | A1 | 9/2008 | Honda et al. | |
| 2008/0227018 | A1 | 9/2008 | Awamura et al. | |
| 2008/0233498 | A1 | 9/2008 | Yamada et al. | |
| 2008/0233505 | A1 | 9/2008 | Nagatomo et al. | |
| 2008/0280218 | A1 | 11/2008 | Sabu et al. | |
| 2008/0280219 | A1 | 11/2008 | Nakayama et al. | |
| 2008/0292361 | A1 | 11/2008 | Seshita et al. | |

FOREIGN PATENT DOCUMENTS

| | | |
|---|---|---|
| JP | 2001-232296 | 8/2001 |
| JP | 2002-72561 | 3/2002 |
| JP | 3291587 | 3/2002 |
| JP | 2002-162772 | 6/2002 |
| JP | 2003-175343 | 6/2003 |
| JP | 3715786 | 9/2005 |
| JP | 2006-47331 | 2/2006 |
| JP | 2006-159075 | 6/2006 |
| JP | 2006-293268 | 10/2006 |
| JP | 3919164 | 2/2007 |
| JP | 4011279 | 9/2007 |

* cited by examiner

METHOD OF MANUFACTURING TONER

BACKGROUND OF THE INVENTION

1. Field of the Invention

The present invention relates to a method of manufacturing a toner.

2. Discussion of the Background

Toner images are formed by attaching toner to a latent electrostatic image formed on an image bearing member, transferring the latent electrostatic image to a recording medium and fixing the image thereon upon application of heat in an electrophotographic apparatus or an electrostatic recording apparatus. Full color images are generally formed by color reproduction using toners of four colors of yellow, magenta, cyan and black, i.e., each color image is developed with respective color toners and overlapped a top on a recording medium to form a color image followed by fixing upon application of heat.

Generally, these full color images do not reach the quality with which a user familiar with printing is satisfied and therefore are required to have quality of high fineness and high definition close to that of photographs or printing industry. Under this circumstance, it is known that a toner having a small particle diameter and a sharp particle size distribution is effective to improve the quality.

Electrostatic or magnetic latent images are typically developed with toner.

The toner for use in latent electrostatic images is generally colored particles which include a coloring agent, a charge control agent, and other additives in a binder resin. The methods of manufacturing this toner are typified into pulverization methods and chemical methods (for example, a spray drying method of adjusting spherical mother toner particle material by spraying and drying an organic solvent in droplet state in which binder resin components are dissolved, an o/w type emulsion method of adjusting spherical mother toner particle material by dispersing an organic solvent in which a binder resin component is dissolved in an aqueous medium in droplet form followed by removal of the solvent, a polymerization method, partial polymerization method, etc.). In the pulverization method, a coloring agent, a charge control agent, an offset prevention agent, etc., are melted, mixed and uniformly dispersed in a thermoplastic resin and the obtained toner composition is pulverized and classified to manufacture toner.

According to the pulverization method, toner having excellent characteristics in some degree can be manufactured but selection of toner material is limited. For example, the toner component obtained by melting and mixing is pulverized and classified by a machine affordable in terms of economy. Therefore, the melted and mixed toner composition is manufactured to be inevitably brittle. Thus, when the toner composition is pulverized for making particles, the obtained particles tend to have a wide particle size distribution so that fine particles having a particle diameter of 3 μm or smaller and coarse particles having a particle diameter of 10 μm are classified and removed. This results in an extremely low yield. Classification is conducted by using a typical classifier using air force in most cases. Such a classifier cannot avoid jump-in of particles having a relatively large particle diameter in comparison with the target particle diameter due to disturbance in air wind and thus coarse particles are unavoidably produced.

On the other hand, there are chemical methods such as a polymerization method or an emulsification dispersion method in which mother toner particles or particles containing binder resin are produced in an aqueous medium. As the polymerization method, a suspension polymerization method is known which conducts polymerization after adding a monomer, a polymerization initiator, a coloring agent, a charge control agent, etc., to an aqueous medium containing a dispersion agent to form oil droplets while stirring. In addition, an association method is also known in which particles obtained by using an emulsification polymerization or a suspension polymerization are agglomerated and adhered.

Toner having a small particle diameter with a sharp particle size distribution can be obtained without classification by such methods. However, while toner having a sharp particle size distribution is obtained without classification in some cases, coarse particles are occasionally produced by condensation, agglomeration or peeling of particles attached to the wall of pipe.

Known classifier is used to remove these coarse particles as in the case of the pulverization method. For example, a strainer is used to remove the coarse particles in the granulation process. Unexamined published Japanese patent application No. (hereinafter referred to as JOP) 2002-162772 describes an air wind classification technology by which the remaining amount of the coarse particles is reduced within 10 mg when 100 g of pulverized toner is screened with a screen having a 500 mesh. JOP H04-121112 describes a technology of screening powder in which balls are used to give vibration to a screen. As to the strainer, due to the limitation in terms of the productivity, the mesh of the strainer is inevitably coarse, i.e., 100 μm at minimum, which is more than ten times as large as the toner particle diameter. Thus, the coarse particles are not sufficiently removed.

Furthermore, removing coarse particles by classification using a decanter and the same classification process as in the pulverization method subsequent to drying are thinkable to remove coarse and fine powder. However, adding such a classification process is not preferable because the addition of such an unnecessary process will result in reduction in productivity. Also, that process is just a pneumatic classification simply using the weight difference or the weight difference enlarged by acceleration (typically angular acceleration by rotation power). Therefore, coarse particles having a particle diameter several times as large as the target particle diameter may jump in as described above and a small amount of the coarse particles is mingled in the manufacture product, which causes clogging of the gap in a development device, resulting in creation of non-development portion.

To solve these problems, for example, JOP H06-19201 describes a technology which regulates the form and the opening of a screen to prevent production of coarse particles in the screening process, adhesion of particles due to mechanical heating, and re-agglomeration of particles by van der Waals' forces. A multiple storied gyroshifter is used as a device having screens and performs screening by utilizing mechanical vibration or ultrasonic vibration. However, the opening is significantly larger than the target particle diameter so that the coarse particles are not sufficiently removed. Therefore, the coarse particles that have passed through the development process are not transferred because the coarse particles do not have a sufficient amount of charge and therefore contact with and fracture a cleaning blade when remaining toner is removed thereby. Furthermore, even when the coarse toner particles are transferred and used for development, the transfer property thereof is inferior so that the coarse particles form images at a position different from the target position (transfer dust).

In addition, mother particles obtained by the pulverization method or the polymerization method described above are typically subject to mixing treatment in which the mother particles are mixed with external additives such as inorganic particulates or organic particulates to improve fluidity, charging stability, lubricant property, and cleaning property.

However, subsequent to the mixing process, when the toner having a high chargeability passes through a screen, the toner is charged by the contact with the screen, which may lead to re-agglomeration of the toner. This is significant especially when the screen is made of metal with a small opening size. When toner particles that have just passed through a screen having an opening size of 65 μm or less is screened by another screen having the same opening size, the toner may not pass through but remain on the second screen. This results in reduction of productivity and agglomerated toner is used for development, resulting in occurrence of white spots (hollow defects) in a solid image portion.

SUMMARY OF THE INVENTION

Because of these reasons, the present inventors recognize that a need exists for a method of manufacturing a toner by which coarse particles are removed in a simple process at a different stage from a typical case.

Accordingly, an object of the present invention is to provide a method of manufacturing a toner by which coarse particles are removed in a simple process at a different stage from a typical case specifically with a screen having a small opening size to securely reduce and prevent production and mingling (jump-in) of such coarse particles to toner products.

Briefly these objects and other objects of the present invention as hereinafter described will become more readily apparent and can be attained, either individually or in combination thereof, by a method of manufacturing a toner including granulating mother toner particles in an aqueous medium to obtain a slurry containing the mother toner particles and adjusting a size distribution of the mother toner particles by screening coarse mother toner particles from the slurry with a screen to obtain the toner containing mother toner particulates.

It is preferred that, in the method of manufacturing a toner described above, the screen has a cylindrical form and is set in a fixed manner to remove the coarse mother toner particles in the mother toner particles by applying a centrifugal force to the slurry from an inside of the screen so that the slurry is caused to collide with the screen.

It is still further preferred that, in the method of manufacturing a toner described above, the slurry is caused to collide with the screen to vibrate the screen so that the coarse mother toner particles are removed.

It is still further preferred that, in the method of manufacturing a toner described above, the screen having a cylindrical form is slanted.

It is still further preferred that, in the method of manufacturing a toner described above, the screen satisfies the following relationship: Dv (μm)×2≦W (μm)≦Dv (μm)×4. In the relationship, Dv represents the weight average particle diameter of the mother toner particulates and W represents the opening size of the screen.

It is still further preferred that, in the method of manufacturing a toner described above, the slurry has a solid portion having a density of from 10 to 40% by weight.

It is still further preferred that, in the method of manufacturing a toner described above, the slurry has a viscosity of from 5 to 300 cps.

It is still further preferred that, in the method of manufacturing a toner described above, the screen has an opening size of from 3 to 36 μm.

It is still further preferred that, in the method of manufacturing a toner described above, the screen is a non-metal screen and has an amount of charge of from −20 to −60 μC/g.

It is still further preferred that, in the method of manufacturing a toner described above, the non-metal screen is formed of polyester.

It is still further preferred that, in the method of manufacturing a toner described above, the mother toner particulates have a weight average particle diameter Dv of from 3 to 7 μm.

It is still further preferred that, in the method of manufacturing a toner described above, a ratio Dv/Dn of the weight average particle diameter Dv of the mother toner particulates to a number average particle diameter Dn thereof ranges from 1.05 to 1.25.

It is still further preferred that the method of manufacturing a toner described above further includes externally adding an external additive to the mother toner particulates.

It is still further preferred that, in the method of manufacturing a toner described above, the slurry is caused to intermittently collide with the screen.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and the accompanying drawings.

Figure 1:
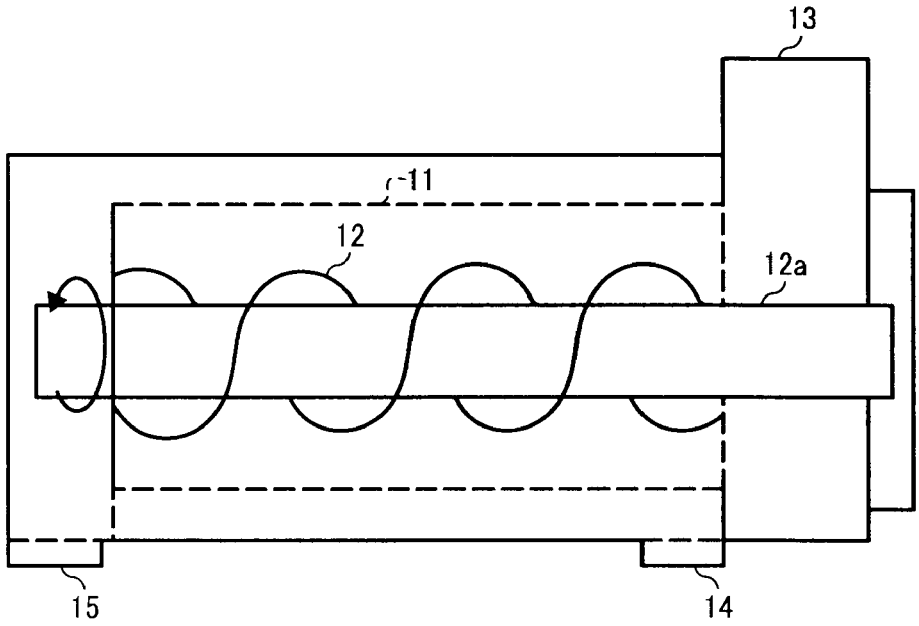
FIG. 1 is a schematic diagram illustrating an example of the classifier for use in the present invention.

FIG. 1 is a schematic cross-section illustrating an example of a wet type classifier for use in the particle size distribution adjustment process (screening process). This classifier classifies a slurry (mother toner particle) and includes a screw 12 which rotates at a high speed inside a cylindrical screen 11. The screw 12 is fixed to a rotation axis 12*a* and the rotation axis 12*a* is arranged in the center portion of the inside of the cylindrical screen 11 along the axis of the screen 11 and supported at the right and left ends by respective bearings (not shown). A driving force is conveyed to rotate the screw 12. A slurry supply mouth 13 is provided to the rotation axis 12A in this example to supply classified material to the inside of the cylindrical screen 11. In this wet type classifier, the classified material is discharged from a collection portion 14 and coarse particles are discharged from a coarse particle discharging mouth 15. The cylindrical screen 11 in this classifier is not arranged horizontally, but slightly slanted with the slurry supply mouth 13 downward to the opposite end. However, the classifier for use in the present invention is not necessarily slanted but can be situated horizontally or upright (i.e., the rotation axis is upright).

In the present invention, the cylindrical screen 11 has a mesh size (opening size) of from 3 to 100 μm, preferably from 3 to 65 μm, more preferably from 3 to 36 μm, further preferably from 3 to 28 μm and particularly preferably 3 to 20 μm depending on the conditions such as viscosity of a slurry and the content ratio of the solid portion in a slurry.

According to the classifier having this structure, the cylindrical screen 11 receives intermittent vibration due to the rotation of the screw 12 together with intermittent discharging contact of the slurry with the screen. This vibration accelerates separation (screening). The cycle of the vibration depends on the number of rotation of the rotation axis 12A, the angle, height and inclination of the screw 12, etc.

Furthermore, in the present invention, the screw 12 and the slurry supply mouth 13 are not limited to those shown in FIG. 1.

The slurry supplied from the slurry supply mouth 13 collides with the screw 12 and is un-agglomerated. Then, the slurry collides with the cylindrical screen 11 and mother toner particles (slurry) having a particle diameter smaller than the opening size pass through the cylindrical screen 11 to the outside and are collected at the collection portion 14. Coarse particles move inside the cylindrical screen 11 and then are discharged to the outside through the coarse particle discharging mouth 15. In addition, the slurry collides with and hits the inside of the cylindrical screen 11 at odd intervals by centrifugal due to the high speed rotation of the screw 12 of the cylindrical screen 11 and therefore clogging of the cylindrical screen 11 is prevented.

The first advantage of the classifier for use in the present invention is that the classifier can classify slurry material. A slurry matter is free from toner agglomeration due to charging generated between particles in air and/or particles and a screen in a dry manufacturing method and therefore does not causes clogging due to agglomeration ascribable to charging, which significantly improves the productivity of toner manufacturing. The second advantage is that toner agglomeration caused by a dispersion device can be preliminarily de-agglomerated and sufficiently de-agglomerated by the rotating screw 12. Therefore, the agglomeration hardly decreases the productivity or causes clogging.

Another advantage is that a strong centrifugal is applied to a slurry containing mother toner particles to pass the mother toner particles through the screen 11. In a typical device, only gravity is used to make toner particles pass through a screen in a dry manufacturing method. In the case of a slurry, a fixed screen is used based on the flowing amount of the slurry. Therefore, a screen having a small opening size is not suitable in terms of the productivity. However, the device for use in the present invention applies another force (i.e., centrifugal) to a slurry so that a screen having almost the same opening size as that of the toner particle can be used.

The screw 12 of the classifier for use in the present invention is formed of, for example, multiple stays (e.g., board form), which are attached to the rotation axis. The number of rotation ranges from about 500 to about 2,000 rpm. Any known screens can be used but non-metal screens are preferred to prevent agglomeration caused by charging. In addition, in terms of the size of an opening size and subtle vibration, a screen formed of resin such as polyester and amide is more preferable.

The classifier for use in the present invention deals with mother toner particulates having a weight average particle diameter of from about 3 to about 15 μm, suitably from 3 to about 8 μm, and particularly suitably about 3 to about 7 μm. Typically, such toner is classified in a dry manufacturing method by a screen having an opening size of from about 30 to about 50 μm to remove coarse particles. The classifier for use in the present invention can sufficiently deal with mother toner particulates having a weight average particle diameter of 5 μm. Thereby, coarse particles having a two fold or four fold target particle diameter can be removed. That is, coarse particles having a particle diameter slightly larger than a target particle diameter can be removed.

The method of manufacturing a toner of the present invention is suitably applied to chemical methods in which liquid is used to adjust the size of mother toner particles (slurry). Especially, a chemical method having a granulation process in an aqueous medium, a particle size distribution adjustment process of adjusting the particle size distribution of mother toner particles or toner powder and an external addition process of adding an external additive to mother toner particulates prepared from the mother toner particles.

The method of manufacturing a toner of the present invention can be applied to toner manufactured by a pulverization method. However, it is preferred to include a classification process in the granulation processes in an aqueous medium instead of bothering to add a process of making slurry in a pulverization method.

Dv of mother toner particulates ranging from 3 to 8 μm is preferred and, from 3 to 7 μm, is more preferred.

When the weight average particle diameter Dv of mother toner particulates are greater than 8 μm, the toner is sufficiently screened by the screen for use in the present invention but a known screen can be also used. In the case of a toner having a weight average particle diameter Dv smaller than 3 μm, the impact of coarse toner particles is not clear in the case of the toner having a weight average particle diameter Dv smaller than 3 μm.

In addition, the ratio (Dv/Dn) of the weight average particle diameter Dv to the number average particle diameter Dn is preferably from 1.05 to 1.25. A ratio that is too large is not preferred because the amount of clogging of toner increases in the screening process, which leads to deterioration of productivity.

Furthermore, the slurry supplied to the particle size distribution adjustment process preferably has a viscosity of from 5 to 300 cps in the present invention. The slurry in an aqueous medium obtained from the process of granulating mother toner particles is directly supplied to the particle size distribution adjustment process or preferably slightly diluted before the particle size distribution adjustment process.

The method of manufacturing a toner of the present invention is suitably applied to chemical methods, especially, a suspension polymerization method, an emulsification polymerization method, and a polymer suspension method, in which an oil phase is emulsified, suspended, or agglomerated in an aqueous medium to form mother toner particles (slurry). In addition, with regard to toner, toner having a small particle diameter with a spherical form including a form slightly deformed from a sphere is preferred. Such toner is manufactured by, for example, a suspension polymerization method (including elongation reaction of polymer molecular chains, and partial polymerization such as polymerization, cross-linking and curing reaction of an olygomer composition), an emulsification method, and a polymerization suspension method, in which an oil phase including a binder resin component and/or its precursor is emulsified, suspended, agglomerated in an aqueous medium to form mother toner particles.

Below are descriptions about examples of the methods of manufacturing the toner and the materials and the additives used therein.

Suspension Polymerization Method

A coloring agent, a releasing agent, etc., are dispersed in an oil soluble polymerization initiator and a polymerizable monomer and the obtained oil phase is emulsified and dispersed in an aqueous medium containing a surface active agent and other solid dispersion agents by the emulsification method described later. Subsequent to polymerization reaction and granulation, an inorganic particulate as an external additive is attached to the surface of the granulated toner particles by the wet type treatment described later. This treatment is preferably conducted to toner particles from which extra surface active agents, etc. are washed away and removed.

Specific examples of the polymerizable monomers include, but are not limited to, acids such as acrylic acid, methacrylic acid, α-cyanoacrylic acid, α-cyanomethacrylic acid, itaconic acid, crotonic acid, fumaric acid, maleic acid and maleic anhydride; acrylamide, methacrylamide and diacetoneacrylamide and their methylol compounds; and acrylates or methacrylates such as having an amino group such as vinyl pyridine, vinyl pyrrolidone, vinyl imidazole, ethylene imine and dimethylaminoethyl methacrylate. A functional group can be introduced into the surface of toner particles by using such a polymerizable monomer.

In addition, a dispersion agent having an acid group or a base group is suitably selected to introduce a functional group because such a dispersion agent can be absorbed on the surface of particles.

Emulsification Polymerization Agglomeration Method

LATEX® is synthesized by a typical emulsification polymerization method in which a water soluble polymerization initiator and a polymerizable monomer are emulsified in water using a surface active agent. Separately, a coloring agent, a releasing agent, etc. are dispersed in an aqueous medium to prepare a dispersion body. After mixing the LATEX® and the dispersion body, the resultant is agglomerated to a toner size followed by heating and adhesion to obtain toner. Thereafter, the resultant is subject to the wet type treatment of inorganic particulates as an external additive described later. A functional group can be introduced to the surface of toner particles by using a monomer similar to the monomer used in the suspension polymerization method as LATEX®.

Polymer Suspension Method

Water can be used alone or in combination with a water soluble solvent as the aqueous medium for use in the polymer suspension method. Specific examples of such water soluble solvents include alcohols (such as methanol, isopropanol and ethylene glycol), dimethylformamide, tetrahydrofuran, cellosolves (such as methyl cellosolve) and lower ketones (such as acetone and methyl ethyl ketone).

A resin, a prepolymer, a coloring agent such as a pigment, a releasing agent, a charge control agent, etc. are dissolved or dispersed in a volatile solvent to foam an oil phase.

The oil phase containing a toner component is dispersed in an aqueous medium under the presence of a surface active agent, a solid dispersion agent, etc. to conduct reaction of the prepolymer for granulation followed by the wet type treatment of inorganic particulates as an external additive described later.

A copolymer with a monomer having a functional group for used in the suspension polymerization method or an acid monomer having three or more functional acid groups in the case of a polyester resin is used to introduce a functional group to a toner particle. Also, an acid group at the end of an obtained polyester resin can be esterified by a compound having at least two functional groups. Furthermore, an acid group can be introduced by using a surface active agent, a polymer having a polarity, an organic or inorganic particulate having the acid group as a dispersion stabilizer. Specific examples of such acid groups include, but are not limited to, carboxyl group, sulfone group, sulfuric acid group, and phosphoric group.

The toner of the present invention is preferably a toner obtained by dissolving or dispersing at least a compound having an active hydrogen group, a polymer having a portion reactive with an active hydrogen group, a polyester, a coloring agent and a releasing agent in an organic solvent to form a toner composition liquid followed by cross-linking and/or elongation reaction in an aqueous medium.

Below are the descriptions about the toner composition material and its manufacturing method.

Modified Polyester

The toner related to the present invention includes a binder resin and a modified polyester (I). The modified polyester (I) includes a chemical bonding other than ester bonding in a polyester resin or a resin component having a different structure which is linked with covalent bonding or ion bonding in a polyester resin. To be specific, a functional group such as an isocyanate group reactive with carboxylic acid and (active hydrogen group of) hydroxyl group is introduced to the end of a polyester followed by reaction with a compound containing an active hydrogen group to modify the end of the polyester.

A specific example of the modified polyester (I) includes, but are not limited to, a urea-modified polyester obtained by reaction of a polyester prepolymer (A) having an isocyanate group with an amine (B). Specific examples of the polyester prepolymers (A) having an isocyanate group include a compound prepared by reacting a polyester, i.e., a polycondensation product of a polyol (1) and a polycarboxylic acid (2) having an active hydrogen group, with a polyisocyanate (3). Specific examples of the active hydrogen groups contained in the polyesters mentioned above include, but are not limited to, hydroxyl groups (alcohol hydroxyl groups and phenol hydroxyl groups), amino groups, carboxylic groups, and mercarpto groups. Among these, alcohol hydroxyl groups are preferred.

Urea modified polyesters are prepared as follows:

Suitable polyols (PO) include diols (DIO) and polyols (TO) having three or more hydroxyl groups. It is preferable to use a DIO alone or mixtures in which a small amount of a TO is mixed with a DIO.

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used. Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a TC is mixed with a DIC.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (TC), anhydrides or lower alkyl esters (e.g., methyl esters, ethyl esters or isopropyl esters) of the polycarboxylic acids mentioned above can be used for the reaction with a polyol.

Suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha,\alpha,\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. When the [NCO]/[OH] ratio is too low, the content of urea in a urea modified polyester is low, which easily degrades the hot offset durability.

The content of the constitutional component of a polyisocyanate (PIC) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner tends to deteriorate and in addition a good combination of the heat resistance and low temperature fixability of the toner is not easily obtained. In contrast, when the content is too high, the low temperature fixability of the toner tends to deteriorate.

The number of isocyanate groups included in the polyester prepolymer (A) per molecule is normally not less than 1, preferably from 1.5 to 3, and more preferably from 1.8 to 2.5. When the number of isocyanate groups is too small, the molecular weight of the modified polyester tends to decrease and thereby the anti-hot offset property tends to deteriorate.

Specific preferred examples of the amine (B) to react with the polyester prepolymer (A) include, but are not limited to, diamines (B1), polyamines (B2) having three or more amino groups, amino alcohols (B3), amino mercaptans (B4), amino acids (B5) and blocked amines (B6) in which the amines (B1-B5) mentioned above are blocked.

Specific preferred examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, and triethylene tetramine. Specific preferred examples of the amino alcohols (B3) include ethanol amines and hydroxyethyl anilines. Specific examples of the amino mercaptans (B4) include aminoethyl mercaptans and aminopropyl mercaptans. Specific preferred examples of the amino acids (B5) include amino propionic acids and amino caproic acids.

Specific examples of the blocked amines (B6) of B1 to B5 include ketimine compounds which are prepared by reacting one of the amines B1-B5 mentioned above with a ketone such as acetone, methyl ethyl ketone and methyl isobutyl ketone; oxazoline compounds, etc. Among these amines (B), B1 and a mixture of B1 and a small quantity of B2 are preferred.

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. In the amino group [NHx], X is 1 or 2, and mostly 2. When ([NCO]/[NHx]) is too great or too small, the molecular weight of the resultant urea-modified polyester (i) tends to decrease, resulting in deterioration of the anti-hot offset property of the resultant toner.

In the present invention, polyesters modified by a urea linkage, i.e., the modified polyester (i) can include a urethane linkage as well as a urea linkage. The molar ratio of the content of the urea linkage to the content of the urethane linkage is normally from 100/0 to 10/90, preferably from 80/20 to 20/80 and more preferably from 60/40 to 30/70. When the molar ratio of the urea linkage is too small, the hot offset durability of the resultant toner tend to deteriorate.

The modified polyester (I) for use in the present invention can be prepared by a method such as a one-shot method or a prepolymer method. The weight average molecular weight of the modified polyester (I) is not less than 10,000, preferably from 20,000 to 10,000,000 and more preferably from 30,000 to 1,000,000. The peak molecular weight is preferably from 1,000 to 10,000. When the peak molecular weight is too small, the elongation reaction tends to hardly occur and the resilience of the toner tends to be small, resulting in deterioration of the hot offset durability. A peak molecular weight that is too large tends to reduce the fixability and create manufacturing problem in the granulation and/or the pulverization process. There is no specific limit to the number average molecular weight of the modified polyester (I) when the polyester (II) described later is used. A suitable number average molecular weight is selected to obtain the weight average molecular weight mentioned above. When the polyester (I) is singly used, the number average molecular weight is normally less than 20,000, preferably from 1,000 to 10,000 and more preferably from 2,000 to 8,000. A number average molecular weight that is excessively large tends to cause deterioration of the low temperature fixing property and gloss in the case of a full color apparatus.

Furthermore, in the cross-linking reaction and/or elongation reaction between the polyester prepolymer (A) and the amine (B) to obtain the modified polyester (I), the molecular weight of the urea-modified polyester resins can be controlled by using a molecular-weight control agent (reaction termination agent), if desired. Specific preferred examples of the molecular-weight control agent include, but are not limited to, monoamines (e.g., diethyle amine, dibutyl amine, butyl amine and lauryl amine), and blocked amines (e.g., ketimine compounds) prepared by blocking the monoamines mentioned above.

Unmodified Polyester

In the present invention, not only can the urea-modified polyester resin (I) mentioned above be used alone as a toner binder constituent, but also the unmodified polyester (II) can be contained as a binder resin in combination with the modified polyester (II). A combinational use of (I) and (II) can improve the low temperature fixability and gloss property when the toner is used in a full color device and thus is preferable to the single use of (I).

Specific preferred examples of the unmodified polyester resins (II) include, but are not limited to, polycondensation products of polyol (PO) and polycarboxylic acid (PC) as mentioned above for use in the polyester constituents of the modified polyester (I) mentioned above. Specific preferred examples of the unmodified polyester resins (II) are the same as those for the modified polyester resins (I). In addition, the unmodified polyester resins (II) include not only unmodified polyesters but also polyester resins modified by a chemical linkage other than urea linkage, for example, urethane linkage. It is preferred that (I) and (II) are at least partially compatible with each other in terms of the low temperature fixability and the hot offset durability.

Therefore, it is preferred, but not mandatory, that the unmodified polyester resins (II) have a similar composition to that of the polyester component of the unmodified polyester resins (I). The weight ratio of (I)/(II) is normally from 5/95 to 80/20, preferably from 5/95 to 30/70, more preferably from 5/95 to 25/75 and even more preferably from 7/93 to 20/80 when (II) is contained. When the weight ratio of the modified polyester (I) is too small, the anti-hot offset property of the toner tends to deteriorate and in addition it is difficult for the toner to have a good combination of a high temperature preservability and a low temperature fixability.

The peak weight average molecular weight of the unmodified polyester (II) is normally from 1,000 to 10,000, preferably from 2,000 to 8,000, and more preferably from 2,000 to 5,000. When the peak molecular weight is too small, the high temperature preservability tends to deteriorate. When the peak molecular weight is too large, the low temperature fixability tends to deteriorate. The hydroxyl group value of the unmodified polyester resin (II) is preferably not less than 5 mgKOH/g, more preferably from 10 to 120 mgKOH/g and even more preferably 20 to 80 mgKOH/g. When the hydroxyl group value of the unmodified polyester (II) is too small, it is disadvantageous to obtain a toner having a good combination of a high temperature preservability and a low temperature fixability. The acid value of the unmodified polyester resin (II) is normally from 1 to 5 mgKOH/g, and preferably from 2 to 4 mgKOH/g. Since a wax having a high acid value is used, a binder having a low acid value is suitable in terms of charging and volume resistance and when used in a two-component development agent.

In the present invention, the resin as a toner binder has a glass transition temperature (Tg) of from 35 to 70° C., and preferably from 55 to 65° C. When the glass transition temperature is too low, the high temperature preservability of the toner tends to deteriorate. When the glass transition temperature is too high, the low temperature fixability tends to be insufficient. Since the urea-modified polyester resin tends to exist in the surface of obtained mother toner particles, the toner for use in the present invention tends to have a good high temperature preservability even when the toner has a relatively low glass transition temperature compared with that of a known polyester-based toner.

Coloring Agent

Suitable coloring agents for use in the toner component of the present invention include any known dyes and pigments.

Specific examples of such coloring agents include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent is preferably from 1 to 15% by weight, and more preferably from 3 to 10% by weight, based on the total weight of the toner component.

Master batch pigments, which are prepared by combining a coloring agent with a resin, can be used as the coloring agent of the toner composition of the present invention. Specific examples of the resins for use in the master batch pigments or for use in combination with master batch pigments include, but are not limited to styrene polymers and substituted styrene polymers such as polystyrene, poly-p-chlorostyrene and polyvinyltoluene, copolymers of a vinyl compound therewith, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

Charge Controlling Agent

Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these, compounds which control to negatively charge a toner are preferably used.

The content of the charge controlling agent is determined depending on the species of the binder resin used, whether or not an additive is added and toner manufacturing method (such as dispersion method) used, and is not particularly limited. However, the content of the charge controlling agent is from 0.1 to 10 parts by weight, and preferably from 0.2 to 5 parts by weight, based on 100 parts by weight of the binder resin included in the toner. When the content is too high, the toner tends to have too large chargeability, and thereby the electrostatic force of a developing roller attracting the toner increases, resulting in deterioration of the fluidity of the toner and a decrease of the image density of toner images.

Releasing Agent

A wax having a low melting point, i.e., from 50° C. to 120° C., is preferably used since waxes having a low melting point effectively function between a fixing roller and the surface boundary of toner when dispersed with the resin. Therefore, such a wax having a low melting point has a good hot offset durability even in an oil free fixing system, in which a wax such as oil is not applied to a fixing roller.

Specific examples of such waxes include natural waxes such as plant waxes such as carnauba wax, cotton wax, haze wax, and rice wax, animal waxes such as yellow bees wax and lanoline, mineral waxes such as ozokerite and petroleum waxes such as paraffin, microcrystalline wax and petrolatum. Other than these natural waxes, synthetic hydrocarbon waxes such as Fisher-Tropsch wax and polyethylene wax, and synthetic waxes such as esters, ketones, and ethers can be used. Further, fatty acid amides such as 1,2-hydroxystearic acid amide, stearic acid amides, anhydrous phthalic acid imides and chlorinated hydrocarbons, homo polymers or copolymers (e.g., copolymers of n-staryl acrylate-ethylmethacrylate) of a polyacrylate, which is a crystalline polymer resin having a relatively low molecular weight, such as poly-n-stearyl methacrylate and poly-n-lauric methacrylate, and crystalline polymers having a long chain alkyl group on its branched chain can be also used.

In addition, the charge control agent and the releasing agent can be directly dissolved or dispersed with a master batch or a binder resin or added when the toner constituents are dissolved or dispersed in an organic solvent.

The classification process in the present invention is added after granulation in the respective toner manufacturing methods specified above.

The classification is preferably conducted after toner particles are granulated and the surface active agent, etc. are washed away and removed.

Extra surface active agent present in the aqueous medium is removed by a solid and liquid separation operation such as filtration and centrifugal to obtain slurry, which is thereafter dispersed in the aqueous medium again.

At this point, the viscosity of the aqueous phase is preferably from 5 to 300 cps and more preferably from 5 to 100 cps. When the viscosity is less than 5 cps, the particulate can be classified. However, the content of the solid portion is small, which may lead to a low productivity. In contrast, when the viscosity of the aqueous phase is too strong, the viscosity of the slurry tends to be strong. Thus, the slurry tends to hardly pass through a screen having a small opening size, resulting in a low productivity.

The density of the solid portion in the slurry is preferably from 10 to 40% by weight. With regard to this density, according to the same reason as described above, the productivity easily deteriorates when the density is too thin. When the density is too thick, the viscosity of slurry tends to be high and agglomeration of the particulates produced in a dry manufacturing method is not sufficiently detangled, which leads to deterioration of efficiency.

Subsequent to these processes of granulation of particulates and classification thereof followed by drying, an external additive can be added to the obtained particles.

External Additive

Inorganic particulates such as metal oxides, metal carbides, nitride nitrides and metal carbonates can be externally added to the toner.

Specific examples thereof include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide and silicon nitride.

Furthermore, organic particulates can also be used as the external additives. For example, polymer particulates such as polymers and copolymers of styrene, methacrylates and acrylates; polymers prepared by polycondensation polymerization, such as silicone resins, benzoguanamine resins and nylon resins; and thermosetting resins, which can be prepared by a soap-free emulsion polymerization method, a suspension polymerization method or a dispersion polymerization method can also be used.

External additives for use in the toner of the present invention are subject to a surface treatment to improve hydrophobic property, thereby preventing deterioration of the fluidity and charging properties of a toner even in a high humid environment. Specific preferred examples of the surface preparation agents include, but are not limited to, silane coupling agents which may contain an alkyl group or fluoroalkyl group, titanate coupling agents, coupling agents such as aluminum coupling agents, silicone oil, higher aliphatic acids, and fluorine compounds.

Especially, silane coupling agents as an example of the coupling agents are used to improve the hydrophobic property and fluidity. Specific examples of the silane coupling agents include, but are not limited to, chlorosilane, alkoxy silanes, silazane, and a special silylization agent. Among these, alkoxy silanes are preferred. Specific examples of the alkoxy silanes include, but are not limited to, vinyltrimethoxy silane, propyl trimethoxy silane, I-butyl trimethoxy silane, n-butyl trimethoxy silane, n-hexyl trimethoxy silane, n-octyl trimethoxy silane and n-dodecyl trimethoxy silane.

Specific examples of the silicone oils include, but are not limited to, polydimethyl siloxane, polymethylphenyl siloxane and polydiphenyl siloxane. Furthermore, silixanes containing fluorine can be also used.

As the fluorine compounds. Organic silicon compounds having a fluorine atom are preferred. Specific examples thereof include, but are not limited to, 3,3,4,4,5,5,6,6,6-nonafluorohexyl trichloro silane, 3,3,3-trifluoro propyl trimethoxy silane, methyl-3,3,3-trifluoropropyl dichloro silane, dimethoxymethyl-3,3,3-trifluoropropyl silane, and 3,3,4,4,5,5,6,6,6-nonafluoro hexylmethyl dichloro silane.

Specific examples of the higher aliphatic acids include, but are not limited to, stearic acid, oleic acid, palmitic acid and linoleic acid. Metal salts thereof can be also used. Specific examples thereof include, but are not limited to, zinc stearate, aluminum stearate, copper stearate, magnesium stearate, calcium stearate, zinf stearate, magnesium stearate, calcium stearate, zinc oleate, manganese oleate, zinc palmitate, zinc linolate, and calcium linolate.

In addition, with regard to the toner related to the present invention, the external additive is added by a dry mixing in which inorganic/organic particulates such as hydrophobic silica fine powder are subject to external addition treatment together with a medium mixture such as glass beads in a mixer. It is preferred to use a mixer equipped with a jacket to adjust the internal temperatures therein. the external additive is suitably added initially or in the middle. Specific examples of such mixers include, but are not limited to, a v-type mixer, a rocking mixer, a LOEDIGE Mixer, a NAUTA mixer and a HENSCHEL mixer.

In addition, wet mixing is used for external addition treatment to toner in an aqueous and/or alcohol solvent. In this wet mixing, an external additive is placed in toner dispersed in an aqueous medium to attach the external additive to the toner. When this external additive is hydrophobized, the surface tension thereof can be reduced by a combinational used with a small amount of alcohol to improve the wettability of the external additive before dispersion. Thereafter, the liquid dispersion is heated to remove the solvent to prevent detachment of the external additive. Thereby, the external additive is uniformly dispersed on the surface of toner. Furthermore, when toner and an external additive is dispersed in an aqueous medium, the external additive is uniformly dispersed on the surface of the toner by addition a surface active agent. A surface active agent having a polarity reverse to that of the external additive or the toner is preferably used.

The classification illustrated in FIG. 1 of JOP H04-121112 uses balls to provide vibration to the screen to improve the screening efficiency. In contrast, the present invention is possible to rapidly filter slurry without a ball. In addition, slurry is inferred to hardly agglomerate in comparison with powder. Therefore, a mesh having a small opening size can be used for slurry without clogging the mesh. Furthermore, it is found that the present invention is advantageous over others considering the comparison results between Examples and Comparative Examples described below.

Having generally described preferred embodiments of this invention, further understanding can be obtained by reference to certain specific examples which are provided herein for the purpose of illustration only and are not intended to be limiting. In the descriptions in the following examples, part(s) and % represent weight ratios in parts and % by weight, unless otherwise specified.

EXAMPLES

The method of manufacturing a toner of the present invention is described with reference to the toner related to the present invention.

Synthesis of Resin Particulate Emulsion

The following recipe is placed in a reaction container equipped with a stirrer and a thermometer and the mixture is agitated for 15 minutes at a rotation number of 400 rpm to obtain a white emulsion.

| | |
|---|---|
| Water | 683 parts |
| Sodium salt of sulfate of an adduct of methacrylic acid with ethyleneoxide (EREMINOR RS-30, manufactured by Sanyo Chemical Industries Ltd.) | 11 parts |
| Styrene | 80 parts |
| Methacrylic acid | 83 parts |
| Butyl acrylate | 110 parts |
| Thioglycol butyrate | 12 parts |
| Ammonium persulfate | 1 part |

The emulsion is heated to 75° C. to conduct reaction for 5 hours. Then, 30 parts of a 1% aqueous solution of ammonium persulfate are added to the emulsion and the mixture is further aged for 5 hours at 75° C. Thus, an aqueous liquid dispersion of [Particulate liquid dispersion 1] of a vinyl based resin (i.e., a copolymer of styrene, methacrylic acid, butyl acrylate and sodium salt of sulfate of an adduct of methacrylic acid with ethyleneoxide) is obtained. The volume average particle diameter of [Particulate liquid dispersion 1] is 50 nm when measured by a laser diffraction particle size distribution measuring device (LA-920, manufactured by Shimadzu corporation). The resin portion of [Particulate liquid dispersion 1] is isolated by drying a part thereof. The isolated resin has a glass transition temperature (Tg) of 42° C. and a weight average molecular weight of 30,000.

Preparation of Aqueous Phase 65 parts of [Particulate liquid dispersion 1] are mixed and stirred with 990 parts of water, 37 parts of a 48.5% aqueous solution of sodium dodecyldiphenyl etherdisulfonate (EREMINOR MON-7, manufactured by Sanyo Chemical Industries, Ltd.), and 90 parts of ethyl acetate to obtain a milk white liquid of [Aqueous phase 1].

Synthesis of Low Molecular Weight Polyester

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg:

| | |
|---|---|
| Adduct of bisphenol A with 2 mole of ethylene oxide | 229 parts |
| Adduct of bisphenol A with 3 mole of propylene oxide | 529 parts |
| Terephthalic acid | 208 parts |
| Adipic acid | 46 parts |
| Dibutyl tin oxide | 2 parts |

44 parts of trimellitic anhydrate is placed in the reaction container to conduct reaction at 180° C. for 2 hours to obtain a non-reactive resin of [Low molecular weight polyester 1]. [Low molecular weight polyester 1] has a number average molecular weight of 2,500, a weight average molecular weight of 6,700, a glass transition temperature of 43° C., and an acid value of 24 mgKOH/g.

Synthesis of Intermediate Polyester

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain [Intermediate polyester 1]:

| | |
|---|---|
| Adduct of bisphenol A with 2 mole of ethylene oxide | 682 parts |
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

[Intermediate polyester 1] has a number average molecular weight of 2,100, a weight average molecular weight of 9,500, a glass transition temperature of 55° C., an acid value of 0.5 mgKOH/g and a hydroxyl value of 51 mgKOH/g.

Synthesis of Modified Polyester Based Resin of [Prepolymer 1] Reactive with Compound having Active Hydrogen Group Next, the following recipe is placed in a container equipped with a condenser, a stirrer and a nitrogen introducing tube to conduct a reaction at 100° C. for 5 hours to obtain [Prepolymer 1]:

| | |
|---|---|
| Intermediate polyester 1 | 410 parts |
| Isophorone diisocyanate | 89 parts |
| Ethyl acetate | 500 parts |

[Prepolymer 1] has an isolated isocyanate weight % of 1.53%.

Synthesis of Ketimine

In a reaction container equipped with a stirrer and a thermometer, 170 parts of isophoronediamine and 75 parts of methyl ethyl ketone are mixed to obtain [Ketimine compound 1]. The amine value of [Ketimine compound 1] is 418 mgKOH/g.

Synthesis of Master Batch 1,200 parts of water, 40 parts of carbon black (REGUL 400R, manufactured by Cabot Corporation), 60 parts of [Low molecular weight polyester 1] and furthermore 30 parts of water are admixed by a HENSCHEL MIXER (manufactured by Mitsui Mining Co., Ltd.). The mixture is mixed and kneaded at 150° C. for 30 minutes by two rolls and rolled and cooled by a pulverizer to obtain [Master batch 1].

Manufacturing Example 1 of Particulate

Manufacturing of Oil Phase

The following is placed in a reaction container equipped with a stirrer and a thermometer:

| | |
|---|---|
| Low molecular weight polyester 1 | 400 parts |
| Carnauba wax | 110 parts |
| Ethyl acetate | 947 parts |

The mixture is agitated, heated to 80° C., and kept at 80° C. for 5 hours and then cooled down to 30° C. in 1 hour. Then, 500 parts of [Master batch 1] and 500 parts of ethyl acetate are added to the reaction container and mixed for 1 hour to obtain [Liquid material 1].

Then, 1,324 parts of [Liquid material 1] are transferred to a reaction container and dispersed using a bead mill (ULTRAVISCOMILL from AIMEX) under the following conditions to disperse the wax:

Liquid feeding speed: 1 kg/hr,
Disc rotation speed: 6 m/sec,
Diameter of zirconia beads: 0.5 mm,
Filling factor: 80% by volume, and
Repeat number of dispersion treatment: 3 times.

Next, 1,324 parts of 65% by weight of ethyl acetic acid solution of [Low molecular weight polyester 1] are added to the wax liquid dispersion. After 1 pass of the bead mill under the same condition specified above, [Pigment wax liquid dispersion 1] is obtained. The density of the solid portion of [Pigment wax liquid dispersion 1] is 50% and measured as follows: heat the solid portion to 130° C.; keep the temperature for 30 minutes; and cool the solid portion down to room temperature.

Emulsification

The following recipe is placed in a container and mixed for 1 minute using a TK HOMOMIXER (manufactured by Tokushu Kika Kogyo Co., Ltd.) at a rotation number of 5,000 rpm.

| | |
|---|---|
| [Pigment wax liquid dispersion 1] | 648 parts |
| [Prepolymer 1] | 154 parts |
| [Ketimine compound 1] | 8.5 parts |

Then, 1200 parts of [Aqueous phase 1] are added in the container and the mixture is mixed for 20 minutes using a TK HOMOMIXER at a rotation number of 10,000 rpm to prepare [Slurry emulsion 1].

That is, the oil phase is dispersed in an aqueous medium containing resin particulates to conduct elongation reaction.

Removal of Solvent

[Slurry emulsion 1] is placed in a reaction container equipped with a stirrer and a thermometer to remove the solvents at 30° C. for 8 hours. Thereafter, the resultant is aged at 45° C. for 4 hours to obtain [Dispersion slurry 1].

Washing 100 parts of [Dispersion slurry 1] are filtered under a reduced pressure to obtain a cake material. Then, the following operations are performed.

(1) 100 parts of deionized water are added to the thus prepared cake material and the mixture is mixed by a TK HOMOMIXER at a rotation number of 12,000 rpm for 10 minutes and then filtered;
(2) 100 parts of a 10% aqueous solution of sodium hydroxide are added to the cake material prepared in (1) and the mixture is mixed for 30 minutes by a TK HOMOMIXER at a rotation number of 12,000 rpm;
(3) 100 parts of a 10% hydrochloric acid are added to the cake material prepared in (2) and the mixture is mixed for 10 minutes by a TK HOMOMIXER at a rotation number of 12,000 rpm and then filtered; and
(4) 300 parts of deionized water are added to the cake material prepared in (3) and the mixture is mixed by a TK HOMOMIXER at a rotation number of 12,000 rpm for 10 minutes and then filtered, and this washing is repeated twice to prepare a cake material.

Surface Treatment 100 parts of deionized water are admixed with the cake material by a TK HOMOMIXER with a rotation number of 12,000 rpm for 10 minutes to obtain [Slurry 1].

This mixture of [Slurry 1] has a solid portion density of 29% and a slurry viscosity density of 89 cps.

The particle diameter of particles contained in [slurry 1] is measured by Coulter Multisizer III (manufactured by Beckman Coulter Inc.) and the following is obtained.

Dv: 5.4 μm
Dv/Dn: 1.19
3.17 μm or less: 11.2%
12.7 μm or greater: 2.1%.

In addition, 200 parts of deionized water instead of the 100 parts mentioned above are admixed thereof to obtain a mixture of [Slurry 2], which has a solid portion density of 15% and a slurry viscosity density of 43 cps.

The particle diameter of particles contained in [slurry 2] is measured by Coulter Multisizer III (manufactured by Beckman Coulter Inc.) and the following is obtained.

Dv: 5.4 μm
Dv/Dn: 1.19
3.17 μm or less: 11.0%
12.7 μm or greater: 2.3%.

Manufacturing Example 2 of Particulate

Preparation of Coloring Agent Liquid Dispersion 1

The following recipe is dissolved and dispersed using ULTRAVISCOMILL from AIMEX to prepare [Coloring agent liquid dispersion 1] in which a coloring agent (black pigment) is dispersed:

| | |
|---|---|
| Carbon black (PRINTEX 35, manufactured by Degussa Corporation) | 125 parts |
| AJISPER PB821 (manufactured by Ajinomoto Fine-Techno Co., Inc.) | 18.8 parts |
| Ethyl acetate (Special grade, manufactured by Wako Pure Chemical Industries, Ltd.) | 356.2 parts |

Preparation of Releasing Agent Liquid Dispersion

Preparation of [Releasing Agent Liquid Dispersion 1] (Wax Component A)

The following recipe is wet-pulverized using ULTRAVISCOMILL from AIMEX to prepare [Releasing agent liquid dispersion 1]:

| | |
|---|---|
| Carnauba wax (melting point: 83° C., acid value: 8 mgKOH/g, saponification value: 80 mgKOH/g) | 30 parts |
| Ethyl acetate (Special grade, manufactured by Wako Pure Chemical Industries, Ltd.) | 270 parts |

The following recipe is mixed and stirred until uniformly mixed to prepare Liquid A.

| | |
|---|---|
| Polyester (1) (Polyester resin, Mw: 50,000, Mn: 3,000, acid value: 15 mgKOH/g, hydroxyl value: 27 mgKOH/g, Tg: 55° C., softening point: 112° C., made of an adduct of bisphenol A with ethylene oxide, adduct of bisphenol A of propylene oxide, and a terephtahlic acid derivative) | 350 parts |
| Coloring agent liquid dispersion 1 | 237 parts |
| Releasing agent liquid dispersion 1 | 72 parts |
| Ethyl acetate (Special grade, manufactured by Wako Pure Chemical Industries, Ltd.) | 304 parts |
| Hydrophobic silicone particulates (R972, manufacture by NIPPON AEROSIL CO., LTD.) | 17.8 parts |

The following is stirred for 3 minutes using a T.K. HOMODISPER fmodel (manufactured by Primix Corporation) to prepare [Liquid B]:

| | |
|---|---|
| Calcium carbide in which 40 parts of calcium carbide particulates are dispersed in 60 parts of water | 100 parts |
| 1% aqueous solution of CELLOGEN BS-H, manufactured by Dai-ichi Kogyo Seiyaku Kogyo Co., Ltd. | 200 parts |
| Water | 157 parts |

Next, 345 parts of [Liquid B] and 250 parts of [Liquid A] are stirred for 2 minutes using a T.K. HOMOMIXER mark2 fmodel (manufactured by Primix Corporation) at a rotation number of 10,000 rpm to obtain a liquid suspension. The solvent is removed from the liquid suspension by stirring the liquid suspension by a propeller type stirring device for 48 hours at room temperature and normal pressure. Then, hydrochloric acid is added to remove calcium carbide. After 100 parts of the resultant are filtered with a reduced pressure to obtain a cake material, (1) 100 parts of deionized water are added to the thus prepared cake material and the mixture is mixed by a TK HOMOMIXER at a rotation number of 12,000 rpm for 10 minutes and then filtered;

(2) 100 parts of a 10% aqueous solution of sodium hydroxide are added to the cake material prepared in (1) and the mixture is mixed for 30 minutes by a TK HOMOMIXER at a rotation of 12,000 rpm;

(3) 100 parts of a 10% hydrochloric acid are added to the cake material prepared in (2) and the mixture is mixed for 10 minutes by a TK HOMOMIXER at a rotation number of 12,000 rpm and then filtered; and (4) 300 parts of deionized water are added to the cake material prepared in (3) and the mixture is mixed by a TK HOMOMIXER at a rotation number of 12,000 rpm for 10 minutes and then filtered, and this washing is repeated twice to prepare a cake material.

Surface Treatment 100 parts of deionized water are admixed with the cake material by a TK HOMOMIXER with a rotation number of 12,000 rpm for 10 minutes to obtain [Slurry 3].

The mixture of [Slurry 3] has a solid portion density of 27% and a slurry viscosity density of 53 cps.

The particle diameter of particles contained in [slurry 3] is measured by Coulter Multisizer III (manufactured by Beckman Coulter Inc.) and the results are as follows:

Dv: 7.0 μm
Dv/Dn: 1.21
3.17 μm or less: 3.1%
12.7 μm or higher: 5.3%.

200 kg of [Slurry 1], [Slurry 2] and [Slurry 3] are separately prepared.

Example 1

Classifier 1

Classifier 1, which employs the structure illustrated in FIG. 1 with an opening size of 36 μm (material: nylon) and a total area of the screen of 3,140 $cm^2$, is used to obtain [Toner 1]. The details and the results are shown in Table 1.

Example 2

Classifier 2

The same classifier as in Example 1 is used except that classifier 2 has an opening size of 10 μm (material: polyester) to obtain [Toner 2].

Comparative Example 1

Classifier 3

350 g of slurry is classified by using a Sharples p600 super decanter (manufactured by Sharples Corporation).

Classifier 3 in this Comparative Example is a centrifugal machine without a screen unlike the classifier for use in the present invention.

Comparative Example 2

Classifier 4

A strainer having an opening size of 36 μm (material: SUS) with a total screen area of 3,000 $cm^2$ is used.

Classifier 4 in this Comparative Example is different from the classifier for use in the present invention. The slurry is flown onto the screen and passes therethrough by gravity.

Comparative Example 3

Classifier 5

An elbojet (typical classifier for powder) is used for classification as Classifier 5 instead of the classifier for use in the present invention in this Comparative Example. In addition, dried powder (including no external additives) is used for classification instead of slurry.

Comparative Example 4

Classifier 6

An ultrasonic vibration screen having an opening size of 36 μm (material: SUS) with a total screen area of 5,024 $cm^2$ is used for classification as Classifier 6 instead of the classifier for use in the present invention in this Comparative Example.

In addition, dried powder (including external additives) is used for classification instead of slurry.

Comparative Example 5

Classifier 7

A turbo screener (manufactured by Turbo Kogyo Co., Ltd.) having an opening size of 36 μm (material: polyester) with a total screen area of 2,750 $cm^2$ is used for classification as Classifier 7 instead of the classifier for use in the present invention in this Comparative Example.

In addition, dried powder (including external additives) is used for classification instead of slurry.

As described above, dried slurries prepared from respective slurries manufactured above are used with regard to Classifier 5. The dried powder for Classifiers 6 and 7 are prepared by mixing 100 parts of dried and solidified slurries prepared from respective slurries manufactured above with 1 part of hydrophobic silica (R972) by HENSCHEL MIXER 20L (manufactured by Mitsui Mining Company, Limited) at a rotation number of 1,400 rpm for 3 minutes.

TABLE 1

| | | Amount (converted in solid portion) | Screen (μm) | Durability | Jump-in of coarse particle |
|---|---|---|---|---|---|
| Example 1 | Classifier 1 (Toner 1) | 200 Kg/hr | 36 | Good | No |
| Example 2 | Classifier 2 (Toner 2) | 200 Kg/hr | 10 | Good | No |
| Comparative Example 1 | Classifier 3 (Toner 3) | 200 Kg/hr | — | Good | Yes |
| Comparative Example 2 | Classifier 4 (Toner 4) | 200 Kg/hr | 36 | Clogged | — |
| Comparative Example 3 | Classifier 5 (Toner 5) | 200 Kg/hr | 36 | Good | Yes |
| Comparative Example 4 | Classifier 6 (Toner 6) | 200 Kg/hr | 36 | Clogged | No |
| Comparative Example 5 | Classifier 7 (Toner 7) | 200 Kg/hr | 36 | Clogged | No |

Example 3

The following recipe is placed in a reaction container equipped with a stirrer and a thermometer and the mixture is agitated for 15 minutes at a rotation number of 400 rpm to obtain a white emulsion.

| | |
|---|---|
| Water | 683 parts |
| Sodium salt of sulfate of an adduct of methacrylic acid with ethyleneoxide (EREMINOR RS-30, manufactured by Sanyo Chemical Industries Ltd.) | 11 parts |
| Styrene | 80 parts |
| Methacrylic acid | 83 parts |
| Butyl acrylate | 110 parts |
| Thioglycol butyrate | 12 parts |
| Ammonium persulfate | 1 part |

The emulsion is heated to 75° C. to conduct reaction for 5 hours. Then, 30 parts of a 1% aqueous solution of ammonium persulfate are added to the emulsion and the mixture is further aged for 5 hours at 75° C. Thus, an aqueous liquid dispersion [Particulate liquid dispersion 1] of a vinyl based resin (i.e., a copolymer of styrene, methacrylic acid, butyl acrylate and sodium salt of sulfate of an adduct of methacrylic acid with ethyleneoxide) is obtained. The volume average particle diameter of [Particulate liquid dispersion 1] is 50 nm when measured by a laser diffraction particle size distribution measuring device (LA-920, manufactured by Shimadzu corporation). The resin portion of [Particulate liquid dispersion 1] is isolated by drying a part thereof. The isolated resin has a glass transition temperature (Tg) of 42° C. and a weight average molecular weight of 30,000.

Preparation of Aqueous Phase 65 parts of [Particulate liquid dispersion 1] are mixed and stirred with 990 parts of water, 37 parts of a 48.5% aqueous solution of sodium dodecyldiphenyletherdisulfonate (EREMINOR MON-7, manufactured by Sanyo Chemical Industries, Ltd.), and 90 parts of ethyl acetate to obtain a milk white liquid [Aqueous phase 1].

Synthesis of Low Molecular Weight Polyester

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg:

| | |
|---|---|
| Adduct of bisphenol A with 2 mole of ethylene oxide | 229 parts |
| Adduct of bisphenol A with 3 mole of propylene oxide | 529 parts |
| Terephthalic acid | 208 parts |
| Adipic acid | 46 parts |
| Dibutyl tin oxide | 2 parts |

44 parts of trimellitic anhydrate is placed in the reaction container to conduct reaction at 180° C. for 2 hours to obtain a non-reactive resin of [Low molecular weight polyester 1]. [Low molecular weight polyester 1] has a number average molecular weight of 2,500, a weight average molecular weight of 6,700, a glass transition temperature of 43° C., and an acid value of 24 mgKOH/g.

Synthesis of Intermediate Polyester

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain an intermediate polyester:

| | |
|---|---|
| Adduct of bisphenol A with 2 mole of ethylene oxide | 682 parts |
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

The intermediate polyester has a number average molecular weight of 2,100, a weight average molecular weight of 9,500, a glass transition temperature of 55° C., an acid value of 0.5 mgKOH/g and a hydroxyl value of 51 mgKOH/g.

Synthesis of Modified Polyester Based Resin of [Prepolymer 1] Reactive with Compound having Active Hydrogen Group Next, the following recipe is placed in a container equipped with a condenser, a stirrer and a nitrogen introducing tube to conduct a reaction at 100° C. for 5 hours to obtain [Prepolymer 1]:

| | |
|---|---|
| Intermediate polyester 1 | 410 parts |
| Isophorone diisocyanate | 89 parts |
| Ethyl acetate | 500 parts |

[Prepolymer 1] has an isolated isocyanate weight % of 1.53%.

Synthesis of Ketimine

In a reaction container equipped with a stirrer and a thermometer, 170 parts of isophoronediamine and 75 parts of methyl ethyl ketone are mixed to obtain [Ketimine compound 1]. The amine value of [Ketimine compound 1] is 418 mgKOH/g.

Synthesis of Master Batch 1,200 parts of water, 40 parts of carbon black (REGUL 400R, manufactured by Cabot Corporation), 60 parts of [Low molecular weight polyester 1] and furthermore 30 parts of water are admixed by a HENSCHEL MIXER (manufactured by Mitsui Mining Co., Ltd.). The mixture is mixed and kneaded at 150° C. for 30 minutes by two rolls and rolled and cooled by a pulverizer to obtain [Master batch 1].

Manufacturing Example 1 of Particulate

Manufacturing of Oil Phase

The following is placed in a reaction container equipped with a stirrer and a thermometer:

| | |
|---|---|
| Low molecular weight polyester 1 | 400 parts |
| Carnauba wax | 110 parts |
| Ethyl acetate | 947 parts |

The mixture is agitated, heated to 80° C., and kept at 80° C. for 5 hours and then cooled down to 30° C. in 1 hour. Then, 500 parts of [Master batch 1] and 500 parts of ethyl acetate are added to the reaction container and mixed for 1 hour to obtain [Liquid material 1].

Then, 1,324 parts of [Liquid material 1] are transferred to a reaction container and dispersed using a bead mill (ULTRAVISCOMILL from AIMEX) under the following conditions to disperse the wax:

Liquid feeding speed: 1 kg/hr,

Disc rotation speed: 6 m/sec,

Diameter of zirconia beads: 0.5 mm,

Filling factor: 80% by volume, and

Repeat number of dispersion treatment: 3 times.

Next, 1,324 parts of 65% by weight of ethyl acetic acid solution of [Low molecular weight polyester 1] are added to the wax liquid dispersion. After 1 pass of the bead mill under the same condition specified above, [Pigment wax liquid dispersion 1] is obtained. The density of the solid portion of [Pigment wax liquid dispersion 1] is 50% and measured as follows: heat the solid portion to 130° C.; keep the temperature for 30 minutes; and cool the solid portion down to room temperature.

Emulsification

The following recipe is placed in a container and mixed for 1 minute using a TK HOMOMIXER (manufactured by Tokushu Kika Kogyo Co., Ltd.) at a rotation number of 5,000 rpm.

| | |
|---|---|
| [Pigment wax liquid dispersion 1] | 648 parts |
| [Prepolymer 1] | 154 parts |
| [Ketimine compound 1] | 10.2 parts |

Then, 1200 parts of [Aqueous phase 1] are added to the container and the mixture is mixed for 20 minutes using a TK HOMOMIXER at a rotation number of 10,000 rpm to prepare [Slurry emulsion 2].

The oil phase is dispersed in an aqueous medium containing resin particulates to conduct elongation reaction.

Removal of Solvent

[Slurry emulsion 2] is placed in a reaction container equipped with a stirrer and a thermometer to remove the solvents at 30° C. for 8 hours. Thereafter, the resultant is aged at 45° C. for 4 hours to obtain [Dispersion slurry 2].

Washing 100 parts of [Dispersion slurry 2] are filtered under a reduced pressure to obtain a cake material. Then, the following operations are performed.

(1) 100 parts of deionized water are added to the thus prepared cake material and the mixture is mixed by a TK HOMOMIXER at a rotation number of 12,000 rpm for 10 minutes and then filtered;

(2) 100 parts of a 10% aqueous solution of sodium hydroxide are added to the cake material prepared in (1) and the mixture is mixed for 30 minutes by a TK HOMOMIXER at a rotation number of 12,000 rpm;

(3) 100 parts of a 10% hydrochloric acid are added to the cake material prepared in (2) and the mixture is mixed for 10 minutes by a TK HOMOMIXER at a rotation number of 12,000 rpm and then filtered; and (4) 300 parts of deionized water are added to the cake material prepared in (3) and the mixture is mixed by a TK HOMOMIXER at a rotation number of 12,000 rpm for 10 minutes and then filtered, and this washing is repeated twice to prepare a cake material.

Screening Treatment 100 parts of deionized water are admixed with the cake material by a TK HOMOMIXER with a rotation number of 12,000 rpm for 10 minutes to obtain [Slurry 4].

This mixture of [Slurry 4] has a solid portion density of 30% and a slurry viscosity density of 89 cps.

The particle diameter of particles contained in [slurry 4] is measured by Coulter Multisizer III (manufactured by Beckman Coulter Inc.) and the following is obtained.

Dv: 4.8 μm

Dv/Dn: 1.15

A classifier, which employs the structure illustrated in FIG. 1 with an opening size of 10 μm (material: nylon) and a total area of the screen of 3,140 $cm^2$, is used to filter [Slurry 4].

Drying and Mixing

The cake obtained by filtering the particulates with the screen is dried at 45° C. for 48 hours using a circulation drier. The obtained dried cake is filtered using a screen having an opening size of 75 μm to obtain [Mother toner particulate 1].

As external additives, 1.5 part of a hydrophobic silica (H2000, manufactured by Clariant) are admixed with 100 parts of [Mother toner particulate 1] by a HENSCHEL MIXER (manufactured by Mitsui Mining Company, Limited) to manufacture [Toner 8].

Example 4

[Toner 9] is manufactured in the same manner as in Example 3 except that the opening size of the screen is changed to 15 μm (material: polyester).

Example 5

[Slurry 5] is prepared in the same manner as in Example 3 except that the addition amount of the deionized water before the filtration treatment is changed from 100 to 200 parts. [Slurry 5] has a solid portion density of 15% and a slurry viscosity of 43 cps. Thereafter, [Slurry 5] is subject to the same treatment as in Example 3 to obtain [Toner 10].

Example 6

5 parts of $Na_3PO_4$ is introduced into 500 parts of deionized water and the resultant is heated to 60° C. followed by stirring by a CLEARMIX high speed stirrer (manufactured by Mtechnique Co., Ltd., peripheral speed of 22 m/s). To the liquid, an aqueous solution in which 2 parts of $CaCl_2$ is dissolved in 15 parts of deionized water is quickly added to obtain an aqueous dispersion medium containing $Ca_3(PO_4)_2$.

Separately, the following recipe is heated to 60° C. and stirred to uniformly dissolve or disperse each material in the polymerizable monomer.

| | |
|---|---|
| Polymerizable monomer: Styrene | 85 parts |
| n-butylacrylate | 20 parts |
| Coloring agent: C.I. Pigment blue 15:3 | 7.5 parts |
| Charge controlling agent E-88 (manufactured by Orient Chemical Industries Ltd.) | 1 part |
| Polarity resin: Saturated polyester (Acid value: 10 mgKOH/g, Peak molecular weight: 7,500 | 5 parts |
| Releasing agent: Ester wax (Maximum endothermic peak temperature by DSC: 72° C.) | 15 parts |
| CLAYTON APA (manufactured by Southern Clay Product Inc.) | 15 parts |

As a polymerization initiator, 3 parts of 2,2'-azobis (2,4-dimethyl valeronitrile) is added to the solution (or liquid dispersion) to prepare a polymerizable monomer component.

The polymerizable monomer component is introduced in the aqueous dispersion medium and the resultant is stirred for 15 minutes by a CLEARMIX high speed stirrer (manufactured by Mtechnique Co., Ltd., peripheral speed of 22 m/s) at 60° C. in nitrogen atmosphere to obtain particles of the polymeric monomer component in the aqueous dispersion medium. Thereafter, the stirrer is stopped and the resultant is introduced into a polymerization device equipped with a full-zone stirring wing (manufactured by Kobelco Eco-Solutions Co., Ltd.). In the polymerization device, the polymeric monomer is subject to 5 hour treatment at 60° C. in nitrogen atmosphere with the stirring wing stirring at maximum stirring peripheral speed of 3 m/s. Thereafter, the temperature is raised to 80° C. and the reaction of the polymeric monomer is conducted for another 5 hours. After the polymerization reaction, 100 parts of the obtained slurry is filtered with a reduced pressure to obtain a cake material, and then (1) 100 parts of deionized water are added to the thus prepared cake material and the mixture is mixed by a TK HOMOMIXER at a rotation number of 12,000 rpm for 10 minutes and then filtered; and (2) 300 parts of deionized water are added to the cake prepared in (1) and the mixture is mixed by a TK HOMOMIXER at a rotation number of 12,000 rpm for 10 minutes and then filtered, and this washing is repeated twice to prepare a cake material.

Screening Treatment 100 parts of deionized water are admixed with the cake material by a TK HOMOMIXER with a rotation number of 12,000 rpm for 10 minutes to obtain [Slurry 6].

The mixture of [Slurry 6] has a solid portion density of 30% and a slurry viscosity density of 89 cps.

The particle diameter of particles contained in [slurry 6] is measured by Coulter Multisizer III (manufactured by Beckman Coulter Inc.) and the result is as follows: Dv: 4.9 μm and Dv/Dn: 1.24.

A classifier, which employs the structure illustrated in FIG. 1 with an opening size of 10 μm (material: nylon) and a total area of the screen of 3,140 $cm^2$, is used for wet classification to filter [Slurry 6].

Drying and Mixing

The cake obtained by filtering and separating the particulates through the screen is dried at 45° C. for 48 hours using a circulation drier. The obtained dried cake is filtered using a screen having an opening size of 75 μm to obtain [Mother toner particulate 2].

1.5 part of a hydrophobic silica (H2000, manufactured by Clariant) are admixed as an external additive with 100 parts of [Mother toner particulate 2] by a HENSCHEL MIXER (manufactured by Mitsui Mining Company, Limited) to manufacture [Toner 11].

Example 7

[Slurry 7] and [Toner 12] are manufactured in the same manner as in Example 3 except that the mixing time for emulsification is changed from 20 to 10 minutes.

Example 8

Preparation of Coloring Agent Liquid Dispersion 1

The following recipe is dissolved and dispersed using ULTRAVISCOMILL from AIMEX to prepare [Coloring agent liquid dispersion 1] in which a coloring agent (black pigment) is dispersed:

| | |
|---|---|
| Carbon black (PRINTEX 35, manufactured by Degussa Corporation) | 125 parts |
| AJISPER PB821 (manufactured by Ajinomoto Fine-Techno Co., Inc.) | 18.8 parts |
| Ethyl acetate (Special grade, manufactured by Wako Pure Chemical Industries, Ltd.) | 356.2 parts |

Preparation of Releasing Agent Liquid Dispersion

Preparation of Releasing Agent Liquid Dispersion 1 (Wax Component A)

The following recipe is wet-pulverized using ULTRAVISCOMILL from AIMEX to prepare [Releasing agent liquid dispersion 1]:

| | |
|---|---|
| Carnauba wax (melting point: 83° C., acid value: 8 mgKOH/g, saponification value: 80 mgKOH/g) | 30 parts |
| Ethyl acetate (Special grade, manufactured by Wako Pure Chemical Industries, Ltd.) | 270 parts |

Preparation of Laminar Compound (Form Irregulation Agent Liquid Dispersion 1) Modified by Organic Cation The following recipe is wet-pulverized using ULTRAVISCOMILL from AIMEX to prepare a laminar compound of [Form irregulation agent liquid dispersion 1]:

| | |
|---|---|
| CLAYTON APA (manufactured by Southern Clay Product Co., Ltd.) | 30 parts |
| Ethyl acetate (Special grade, manufactured by Wako Pure Chemical Industries, Ltd.) | 270 parts |

The following recipe is mixed and stirred until uniformly mixed to prepare [Liquid C].

| | |
|---|---|
| Polyester (1) (Polyester resin, Mw: 50,000, Mn: 3,000, acid value: 15 mgKOH/g, hydroxyl value: 27 mgKOH/g, Tg: 55° C., softening point: 112° C., made of an adduct of bisphenol A with ethylene oxide, an adduct of bisphenol A of propylene oxide, and a terephtahlic acid derivative) | 350 parts |
| Coloring agent liquid dispersion | 237 parts |
| Releasing agent liquid dispersion 1 | 72 parts |
| Form irregulation agent liquid dispersion 1 | 304 parts |
| Hydrophobic silicone particulates (R972, manufacture by NIPPON AEROSIL CO., LTD.) | 17.8 parts |

The following is stirred for 3 minutes using T.K. HOMODISPER fmodel (manufactured by Primix Corporation) to prepare Liquid D:

| | |
|---|---|
| Calcium carbide in which 40 parts of calcium carbide particulates is dispersed in 60 parts of water | 100 parts |
| 1% aqueous solution of CELLOGEN BS-H, manufactured by Dai-ichi Kogyo Seiyaku Kogyo Co., Ltd. | 200 parts |
| Water | 157 parts |

Next, 345 parts of [Liquid D] and 250 parts of [Liquid C] are stirred for 2 minutes using a T.K. HOMOMIXER mark2 fmodel (manufactured by Primix Corporation) at a rotation number of 10,000 rpm to obtain a liquid suspension. The solvent is removed therefrom by stirring the liquid suspension by a propeller type stirring device for 48 hours at room temperature and normal pressure. Hydrochloric acid is added to remove calcium carbide. After 100 parts of the resultant are filtered with a reduced pressure to obtain a cake material, (1) 100 parts of deionized water are added to the thus prepared cake material and the mixture is mixed by a TK HOMOMIXER at a rotation number of 12,000 rpm for 10 minutes and then filtered; and (2) 300 parts of deionized water are added to the cake material prepared in (1) and the mixture is mixed by a TK HOMOMIXER at a rotation number of 12,000 rpm for 10 minutes and then filtered, and this washing is repeated twice to prepare a cake material.

Screening Treatment 100 parts of deionized water are admixed with the cake material by a TK HOMOMIXER with a rotation number of 12,000 rpm for 10 minutes to obtain [Slurry 8].

The mixture of [Slurry 8] has a solid portion density of 30% and a slurry viscosity density of 89 cps.

The particle diameter of particles contained in [slurry 8] is measured by Coulter Multisizer III (manufactured by Beckman Coulter Inc.) and the result is as follows: Dv: 6.1 μm and Dv/Dn: 1.17.

A classifier, which employs the structure illustrated in FIG. 1 with an opening size of 15 μm (material: polyester) and a total area of the screen of 3,140 $cm^2$, is used for wet classification to filter [Slurry 8].

Drying and Mixing

The cake obtained by filtering and separating the particulates through the screen is dried at 45° C. for 48 hours using a circulation drier. The obtained dried cake is filtered using a screen having an opening size of 75 μm to obtain [Mother toner particulate 3].

1.5 parts of a hydrophobic silica (H2000, manufactured by Clariant) are admixed as an external additive with 100 parts of [Mother toner particulate 3] by a HENSCHEL MIXER (manufactured by Mitsui Mining Company, Limited) to manufacture [Toner 13].

Example 9

Manufacturing of Toner 14

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg:

| | |
|---|---|
| Adduct of bisphenol A with 2 mole of ethylene oxide | 229 parts |
| Adduct of bisphenol A with 3 mole of propion oxide | 529 parts |
| Terephthalic acid | 208 parts |

-continued

| | |
|---|---|
| Adipic acid | 46 parts |
| Dibutyl tin oxide | 2 parts |

44 parts of trimellitic anhydrate is placed in the reaction container to conduct reaction at 180° C. for 2 hours to obtain [Low molecular weight polyester 2]. Obtained [Low molecular weight polyester 2] has a number average molecular weight of 2,500, a weight average molecular weight of 6,700, a glass transition temperature of 43° C., and an acid value of 25 mgKOH/g.

1200 parts of water, 470 parts of carbon black (Printex 35, from Degussa AG, which has a dibutyl phthalate (DBP) oil absorption of 42 ml/100 mg and a PH of 9.5), and 530 parts of [Low molecular weight polyester 2] are added and mixed by a HENSCHELMIXERr (manufactured by Mitsui Mining Company, Limited). This mixture is kneaded for 30 minutes at 150° C. using a two-roll mill followed by rolling and cooling. Thereafter, the kneaded mixture is pulverized by a pulverizer (manufactured by Hosokawa Micron Co., Ltd.) to obtain [Master batch 2].

The following is placed and mixed in a reaction container equipped with a stirrer and a thermometer:

| | |
|---|---|
| Low molecular weight polyester 2 | 378 parts |
| Carnauba wax | 110 parts |
| Ethyl acetate | 947 parts |

The mixture is agitated, heated to 80° C., and kept at 80° C. for 5 hours and then cooled down to 30° C. in 1 hour. Then, 500 parts of [Master batch 2] and 500 parts of ethyl acetate are added to the reaction container and mixed for 1 hour to obtain a liquid material.

Then, 1,324 parts of the obtained liquid material are transferred to a reaction container and dispersed using a bead mill (ULTRAVISCOMILL from AIMEX) under the following conditions to disperse C.I. Pigment red and carnauba wax to obtain a wax liquid dispersion:

Liquid feeding speed: 1 kg/hr,
Disc rotation speed: 6 m/sec,
Diameter of zirconia beads: 0.5 mm,
Filling factor: 80% by volume, and
Repeat number of dispersion treatment: 3 times.

Next, 1,324 parts of [Low molecular weight polyester 2] of 65% by weight of ethyl acetic acid solution are added to the wax liquid dispersion. 1.0 part of CLAYTON APA (manufactured by Southern Clay Product Co., Ltd.) is added as a charge controlling agent to 200 parts of a liquid dispersion obtained after 1 pass of ULTRAVISCOMILL under the same condition mentioned above and the mixture is stirred for 60 minutes by using a T.K. HOMODISPER (manufactured by Tokushu Kika Kogyo Co., Ltd. at 7,000 rpm to obtain a liquid dispersion of a toner material.

The following recipe is placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain an intermediate polyester:

| | |
|---|---|
| Adduct of bisphenol A with 2 mole of ethylene oxide | 682 parts |

-continued

| | |
|---|---|
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

The intermediate polyester has a number average molecular weight of 2,100, a weight average molecular weight of 9,500, a glass transition temperature of 55° C., an acid value of 0.5 mgKOH/g and a hydroxyl value of 51 mgKOH/g.

Next, the following components are contained in a container equipped with a condenser, a stirrer and a nitrogen introducing tube to conduct a reaction at 100° C. for 5 hours to obtain a prepolymer:

| | |
|---|---|
| Intermediate polyester | 410 parts |
| Isophorone diisocyanate | 89 parts |
| Ethyl acetate | 500 parts |

The obtained prepolymer has an isolated isocyanate weight % of 1.53%.

The following is placed and mixed in a reaction container equipped with a stirrer and a thermometer for a reaction for 5 hours to synthesize a ketimine compound:

| | |
|---|---|
| Isophorone diamine | 170 parts |
| Methyl ethyl ketone | 75 parts |

The amine value of the obtained ketimine compound is 418 mgKOH/g.

Then, 749 parts of the liquid dispersion of toner material, 115 parts of the prepolymer and 2.9 parts of the ketimine compound are placed in the reaction container and the mixture is mixed for 1 minutes using TK HOMOMIXER (manufactured by Tokushu Kika Kogyo Co., Ltd.) at 5,000 rpm to obtain an oil phase liquid mixture.

The following components are placed in a container equipped with a stirrer and a thermometer and agitated at a rotation number of 400 rpm for 15 minutes to obtain an emulsion.

| | |
|---|---|
| Water | 683 parts |
| Sodium salt of sulfate of an adduct of methacrylic acid with ethyleneoxide (Reactive emulsifying agent, EREMINOR RS-30 from Sanyo Chemical Industries Ltd.) | 11 parts |
| Styrene | 83 parts |
| Methacrylic acid | 83 parts |
| Butylacrylate | 110 parts |
| Ammonium persulfate | 1 part |

Thereafter, the emulsion is heated to 75° C. to conduct a reaction for 5 hours. Then, 30 parts of a 1 weight % aqueous solution of ammonium persulfate are added to the emulsion and the mixture is further aged for 5 hours at 75° C. to obtain resin particulate liquid dispersion. The volume average particle diameter of the obtained resin particulate liquid dispersion is 105 nm when measured by a particle diameter distribution measuring device microtrack super particulate size distribution (UPA-EX150, manufactured by Nikkiso Co., Ltd.). Part of the resin portion is isolated by drying a part of resin particulate liquid dispersion. The isolated resin has a glass transition temperature (Tg) of 59° C. and a weight average molecular weight of 150,000.

83 parts of the resin particulate liquid dispersion are mixed and stirred with the following components to obtain an aqueous medium:

| | |
|---|---|
| Water | 990 parts |
| 48.5% aqueous solution of sodium Dodecyldiphenyl etherdisulfonate (EREMINOR MON-7 from Sanyo Chemical Industries, Ltd.) | 37 parts |
| 1% by weight aqueous solution of polymer dispersion agent carboxymethyl cellulose sodium (CELLOGEN BS-H-3, manufactured by Dai-ichi Kogyo Seiyaku Kogyo Co., Ltd.) | 135 parts |
| Ethyl acetate | 90 parts |

Next, 867 parts of the oil phase liquid mixture is admixed with 1,200 parts of the aqueous medium using a TK HOMOMIXER for 20 minutes at 13,000 rpm to prepare a liquid dispersion (slurry emulsion).

The slurry emulsion is placed in a reaction container equipped with a stirrer and a thermometer to remove the solvents at 30° C. for 8 hours. Thereafter, the resultant is aged at 45° C. for 4 hours to obtain a dispersion slurry, which has a volume average particle diameter (Dv) of 3.3 μm and a ratio (Dv/Dn) of 1.25 (measured by Multisizer III, manufactured by Beckman Coulter Inc.). 100 parts of the slurry dispersion are filtered under a reduced pressure to obtain cake material. Thereafter, 100 parts of deionized water are added to the thus prepared cake material and the resultant is mixed for 10 minutes at a rotation of 12,000 rpm by a TK HOMOMIXER and then filtered. Next, 10% by weight phosphoric acid is added to the resultant cake material to adjust pH to be 3.7 followed by mixing at a rotation of 12,000 rpm by a TK HOMOMIXER for 10 minutes and then filtered.

Furthermore, 300 parts of deionized water are added to the obtained cake material and the resultant is mixed at a rotation number of 12,000 rpm by a TK HOMOMIXER for 10 minutes and then filtered. This washing is repeated twice to obtain a cake material.

Screening Treatment 100 parts of deionized water are admixed with the cake material by a TK HOMOMIXER with a rotation number of 12,000 rpm for 10 minutes to obtain [Slurry 9].

The mixture of [Slurry 9] has a solid portion density of 30% and a slurry viscosity density of 89 cps.

A classifier, which employs the structure illustrated in FIG. 1 with an opening size of 10 μm (material: polyester) and a total area of the screen of 3,140 $cm^2$, is used to filter [Slurry 9].

Drying and Mixing

The cake obtained by filtering and separating the particulates through the screen is dried at 45° C. for 48 hours using a circulation drier. The obtained dried cake is filtered using a screen having an opening size of 75 μm to obtain [Mother toner particulate 4].

1.5 parts of a hydrophobic silica (H2000, manufactured by Clariant) as an external additive are admixed with 100 parts of [Mother toner particulate 4] by a HENSCHEL MIXER (manufactured by Mitsui Mining Company, Limited) to manufacture [Toner 14].

Comparative Example 6

[Toner 15] is manufactured in the same manner as in Example 3 except that the opening size of the screen is changed to 25 μm (material: polyester).

Comparative Example 7

[Toner 16] is manufactured in the same manner as in Example 8 except that the opening size of the filter for the cake material is changed to 25 μm (material: polyester).

Comparative Example 8

In an attempt to manufacture [Toner 17] in the same manner as in Example 8 except that the opening size of the screen (filter) for the cake material is changed to 10 μm (material: nylon), the filter is excessively clogged so that [Toner 17] is not manufactured.

Comparative Example 9

[Slurry 10] is prepared in the same manner as in Example 8 except that another 30 parts of deionized water is added to the cake material to obtain a solid portion density of 20%. In an attempt to manufacture [Toner 18] in the same manner as in Example 8 except that the opening size of the filter for the cake material is changed to 10 μm (material: nylon), the filter is excessively clogged so that [Toner 18] is not manufactured.

Evaluation (1) Transfer Dust

Figure 2:
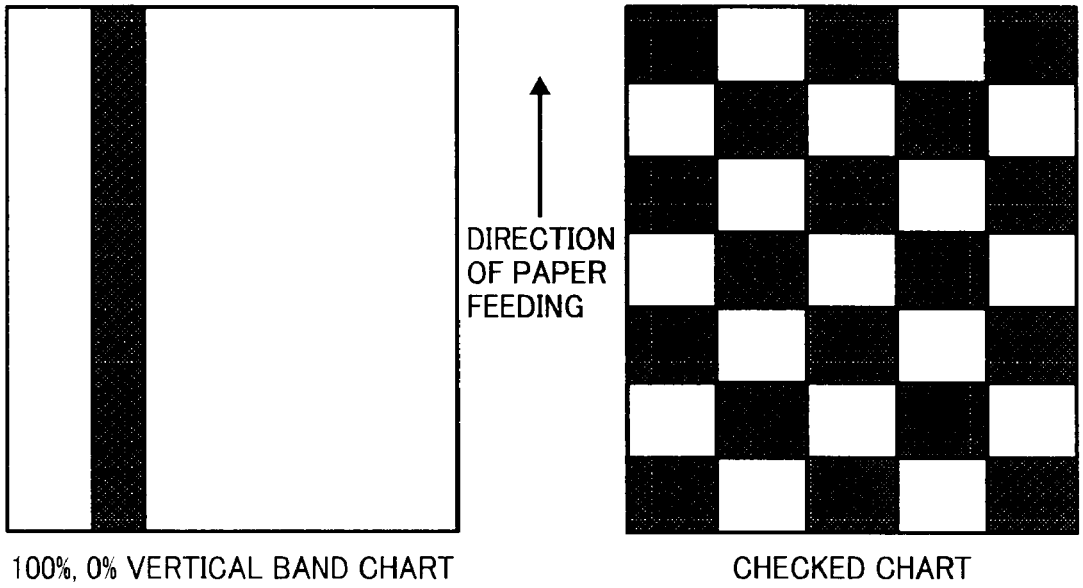
FIG. 2 is diagrams illustrating charts for measuring transfer dust in the evaluation for Examples described later.

1. All the toner and the apparatus for use in evaluation are left in an environment room (25° C. and 50% humidity) for one day.
2. Toner in the process cartridge unit (market product) installed in Imagio neo C600 is all removed and only carrier remains in the development device.
3. 28 g of black toner as sample is placed in the development device accommodating only carrier to prepare 400 g of development agent having a toner density of 7%.
4. The development device is installed to the main body of Imagio neo C600 and then only the development device is rotated with a linear speed of the development sleeve of 300 mm/s in an idling manner for 5 minutes.
5. The development sleeve and the image bearing member are rotated at 300 mm/s in a trailing manner and the charging voltage and the development bias are adjusted such that the toner on the image bearing member is from 0.55 to 0.65 $mg/cm^2$.
6. Only one cleaning blade having an elasticity of 70% and a thickness of 2 mm of the market product for Imagio neo C600 is used with a contact angle of 20° against the image bearing member in a counter manner.
7. The transfer electricity is adjusted such that the transfer ratio is from 94 to 98% under the development condition specified above.
8. Checked images illustrated in FIG. 2 are output using the predetermined values specified above under the environment of 5° C. and 15%.
9. Transfer dust due to coarse particles with regard to the printed images are produced at the rear end of the image because the coarse particles are heavy, which delays transfer. The status of the transfer dust at the rear end of the image are observed with a magnifier with a power of 30 times. The evaluation thereof is as follows:

G (Good): Sharp image

F (Fair): 1 to 3 pieces of dust observed on an A4 image

B (Bad): more than 3 pieces of dust observed.

(2) Chipping (Fracture) of Blade

Evaluation on Cleaning

1. All the toner and the apparatus for use in evaluation are left in an environment room (25° C. and 50% humidity) for one day.
2. Toner contained in the process cartridge (market product) installed in Imagio neo C600 is all removed and only carrier remains in the development device.
3. 28 g of black toner as sample is placed in the development device accommodating only carrier to prepare 400 g of development agent having a toner density of 7%.
4. The development device is installed in the main body of Imagio neo C600 and then only the development device is rotated with a linear speed of the development sleeve of 300 mm/s in an idling manner for 5 minutes.
5. The development sleeve and the image bearing member are rotated at 300 mm/s in a trailing manner and the charging voltage and the development bias are adjusted such that the toner on the image bearing member is from 0.55 to 0.65 mg/cm$^2$.
6. Only one cleaning blade having an elasticity of 70% and a thickness of 2 mm of the market product for Imagio neo C600 is used with a contact angle of 20° against the image bearing member in a counter manner.
7. The transfer electricity is adjusted such that the transfer ratio is from 94 to 98% under the development condition specified above.
8. The bar chart having a portion with a density of 100% and the other portion with a density of 0% as illustrated in FIG. 2 is output on 5,000 sheets using the values specified above under the environment of 10° C. and 15%.
9. After printing, a half tone image is printed and the image and the cleaning blade are observed and evaluated as follows:

G (Good): No defects on image with no problem with cleaning blade

F (Fair): No defects on image but with chipping of blade

B (Bad): Blade is chipped (fractured), which causes production of images having streaks.

(3) Measuring of Particle Diameter

The volume average particle diameter (Dv) and the number average particle diameter (Dn) of the toner manufactured by the present invention are measured by a particle size measuring device (Multisizer III, manufactured by Beckman Coulter Co., Ltd.) with an aperture of 100 μm and analyzed by an analysis software (Beckman Coulter Multisizer 3 Version 3.51). To be specific, 0.5 ml of 10 wt % surface active agent (alkylbenzene sulfonate SC-A, manufactured by Daiichi Kogyo Co., Ltd.) is placed in a glass beaker (100 ml). 0.5 g of each toner is added in the beaker and stirred by a microspatula. 80 ml of deionized water is added to the mixture and the thus obtained liquid dispersion is subject to dispersion treatment for 10 minutes by an ultrasonic wave dispersion device (W-113MK-II, manufactured by Honda Electronics).

The toner sample liquid dispersion is measured by the Multisizer III using ISOTON® III (manufactured by Beckman Coulter Inc.) as the measuring solution.

The toner sample liquid dispersion is dropped such that the density indicated by the measuring device is from 6 to 10%. In this measuring method, it is desired to keep the density in the range mentioned above in terms of measuring reproducibility. The measured particle size does not have an error when the density is in that range.

The evaluation results are shown in Tables 2-1 and 2-2. ER therein represents the density of the solid portion of the slurry.

TABLE 2-1

| | | | | Particle size before screening | | | Screen |
|---|---|---|---|---|---|---|---|
| | Toner | Slurry | ER | Dv (μm) | Dn (μm) | Dv/Dn | size (μm) |
| Example 3 | Toner 8 | Slurry 4 | 30% | 4.8 | 4.2 | 1.15 | 10 |
| Example 4 | Toner 9 | Slurry 4 | 30% | 4.8 | 4.2 | 1.15 | 15 |
| Example 5 | Toner 10 | Slurry 5 | 15% | 4.8 | 4.2 | 1.15 | 10 |
| Example 6 | Toner 11 | Slurry 6 | 30% | 4.9 | 4.0 | 1.24 | 10 |
| Example 7 | Toner 12 | Slurry 7 | 30% | 4.7 | 3.7 | 1.27 | 10 |
| Example 8 | Toner 13 | Slurry 8 | 30% | 6.1 | 5.2 | 1.17 | 15 |
| Example 9 | Toner 14 | Slurry 9 | 30% | 3.3 | 2.6 | 1.25 | 10 |
| Comparative Example 6 | Toner 15 | Slurry 4 | 30% | 4.8 | 4.2 | 1.15 | 25 |
| Comparative Example 7 | Toner 16 | Slurry 8 | 30% | 6.1 | 5.2 | 1.17 | 25 |
| Comparative Example 8 | Toner 17 | Slurry 8 | 30% | 6.1 | 5.2 | 1.17 | 10 |
| Comparative Example 9 | Toner 18 | Slurry 10 | 20% | 6.1 | 5.2 | 1.17 | 10 |

TABLE 2-2

| | Particle size after screening | | | | | |
|---|---|---|---|---|---|---|
| | Dv (μm) | Dn (μm) | Dv/Dn | Transfer dust | Chipping of blade | Evaluation |
| Example 3 | 4.7 | 4.2 | 1.13 | G | G | Excellent |
| Example 4 | 4.8 | 4.2 | 1.15 | G | G | Excellent |
| Example 5 | 4.7 | 4.2 | 1.13 | G | G | Excellent |
| Example 6 | 4.7 | 3.9 | 1.20 | G | G | Excellent |
| Example 7 | 4.5 | 3.6 | 1.24 | F | G | Good |
| Example 8 | 6.0 | 5.2 | 1.16 | G | G | Excellent |
| Example 9 | 3.3 | 2.6 | 1.25 | G | G | Excellent |
| Comparative Example 6 | 4.8 | 4.2 | 1.15 | B | G | Bad |
| Comparative Example 7 | 6.1 | 4.2 | 1.17 | G | B | Bad |
| Comparative Example 8 | Toner is not manufactured due to clogging | | | | | Bad |
| Comparative Example 9 | Toner is not manufactured due to clogging | | | | | Bad |

Manufacturing of Slurry (Mother Toner Particles Before Screening) Manufacturing of [Slurry 11]

Synthesis of Resin Particulate Emulsion

The following recipe is placed in a reaction container equipped with a stirrer and a thermometer and the mixture is agitated for 15 minutes at a rotation number of 400 rpm to obtain a white emulsion.

| | |
|---|---|
| Water | 683 parts |
| Sodium salt of sulfate of an adduct of methacrylic acid with ethyleneoxide (EREMINOR RS-30, manufactured by Sanyo Chemical Industries Ltd.) | 11 parts |
| Styrene | 80 parts |
| Methacrylic acid | 83 parts |
| Butyl acrylate | 110 parts |
| Ammonium persulfate | 1 part |

The emulsion is heated to 75° C. to conduct reaction for 5 hours. Then, 30 parts of a 1% aqueous solution of ammonium persulfate are added to the emulsion and the mixture is further aged for 5 hours at 75° C. Thus, an aqueous liquid dispersion [Particulate liquid dispersion 2] of a vinyl based resin (i.e., a copolymer of styrene, methacrylic acid, butyl acrylate and sodium salt of sulfate of an adduct of methacrylic acid with ethyleneoxide) is obtained. The volume average particle diameter of [Particulate liquid dispersion 2] is 105 nm when measured by a laser diffraction particle size distribution measuring device (LA-920, manufactured by Horiba Ltd.). The resin portion of [Particulate liquid dispersion 2] is isolated by drying a part thereof. The isolated resin has a glass transition temperature (Tg) of 59° C. and a weight average molecular weight of 150,000.

Preparation of Aqueous Phase 83 parts of [Particulate liquid dispersion 2] are mixed and stirred with 990 parts of water, 37 parts of a 48.5% aqueous solution of sodium dodecyldiphenyletherdisulfonate (EREMINOR MON-7, manufactured by Sanyo Chemical Industries, Ltd.), and 90 parts of ethyl acetate to obtain a milk white liquid [Aqueous phase 2].

Synthesis of Low Molecular Weight Polyester

The following recipe is placed in a container equipped with a condenser, a stirrer and a nitrogen introducing tube to conduct a reaction at 230° C. under 1,200 mmHg for 8 hours followed by another reaction for 5 hours with a reduced pressure of 10 to 15 mmHg:

| | | |
|---|---|---|
| Adduct of bisphenol A with | 2 mole of ethylene oxide<br>3 2 mole of propylene oxide | 529 parts |
| Terephthalic acid | | 208 parts |
| Adipic acid | | 46 parts |
| Dibutyl tin oxide | | 2 parts |

Then, 44 parts of trimellitic anhydrate is placed in the reaction container to conduct reaction at 180° C. for 2 hours to obtain [Low molecular weight polyester 2]. [Low molecular weight polyester 2] has a glass transition temperature of 43° C., a weight average molecular weight of 6,700, a number average molecular weight of 2,500, and an acid value of 25 mgKOH/g.

Preparation of Master Batch 1200 parts of water, 540 parts of carbon black (Printex 35, from Degussa AG, which has a dibutyl phthalate (DBP) oil absorption of 42 ml/100 mg and a PH of 9.5), and 1,200 parts of polyester resin (RS801, manufactured by Sanyo Chemical Industries Ltd.) are admixed by a HENSCHELMIXER (manufactured by Mitsui Mining Company, Limited). This mixture is kneaded for 30 minutes at 150° C. using a two-roll mill followed by rolling and cooling. Thereafter, the kneaded mixture is pulverized by a pulverizer (manufactured by Hosokawa Micron Co., Ltd.) to obtain carbon black master batch [Master batch 2].

Synthesis of Prepolymer 2

The following recipe is placed in a container equipped with a condenser, a stirrer and a nitrogen introducing tube to conduct a reaction at 230° C. at normal pressure for 8 hours followed by another reaction for 5 hours under a reduced pressure of 10 to 15 mmHg to obtain [Intermediate polyester 2]:

| | |
|---|---|
| Propylene glycol | 685 parts |
| Terephthalic acid | 665 parts |

-continued

| | |
|---|---|
| Trimellitic anhydrate | 465 parts |
| Titan tetrabutoxide | 2 parts |

[Intermediate polyester 2] has a number average molecular weight of 6,600, a glass transition temperature of 36° C., an acid value of 0.5 mgKOH/g and a hydroxyl value of 20.0 mgKOH/g.

Next, the following recipe is placed in a container equipped with a condenser, a stirrer and a nitrogen introducing tube to conduct a reaction at 100° C. for 5 hours to obtain [Prepolymer 2]:

| | |
|---|---|
| Intermediate polyester 2 | 250 parts |
| Isophorone diisocyanate | 18 parts |
| Ethyl acetate | 250 parts |

[Prepolymer 2] has an isolated isocyanate weight % of 0.61%.

Manufacturing of Oil Phase

The following is placed in a reaction container equipped with a stirrer and a thermometer:

| | |
|---|---|
| Low molecular weight polyester 2 | 378 parts |
| Carnauba wax | 110 parts |
| Metal complex of salicylic acid (E-84, manufactured by Orient Chemical Industries Co., Ltd. | 22 parts |
| Ethyl acetate | 947 parts |

The mixture is agitated, heated to 80° C., and kept at 80° C. for 5 hours and then cooled down to 30° C. in 1 hour. Then, 500 parts of [Master batch 2] and 500 parts of ethyl acetate are added in the reaction container and mixed for 1 hour to obtain [Liquid material 2].

Then, 1,324 parts of [Liquid material 2] are transferred to a reaction container and dispersed using a bead mill (ULTRAVISCOMILL from AIMEX) under the following conditions to disperse the wax:

Liquid feeding speed: 1 kg/hr,

Disc rotation speed: 6 m/sec,

Diameter of zirconia beads: 0.5 mm,

Filling factor: 80% by volume, and

Repeat number of dispersion treatment: 3 times.

Next, 1,324 parts of 65% by weight of ethyl acetic acid solution of [Low molecular weight polyester 2] are added to the wax liquid dispersion. After 1 pass of the bead mill under the same condition specified above, [Pigment wax liquid dispersion 2] is obtained. The density of the solid portion of [Pigment wax liquid dispersion 2] is 50% and measured as follows: heat the solid portion to 130° C.; keep the temperature for 30 minutes; and cool the solid portion down to room temperature.

Emulsification

The following recipe is placed in a container and mixed for 1 minute using a TK HOMOMIXER (manufactured by Tokushu Kika Kogyo Co., Ltd.) at a rotation number of 5,000 rpm.

| | |
|---|---|
| [Pigment wax liquid dispersion 2] | 749 parts |
| [Prepolymer 2] | 115 parts |
| Isophorone diamine | 2.0 parts |

Then, 1200 parts of [Aqueous phase 2] are added to the container and the mixture is mixed for 20 minutes using a TK HOMOMIXER at a rotation of 13,000 rpm to prepare an aqueous medium liquid dispersion.

The aqueous medium liquid dispersion is placed in a reaction container equipped with a stirrer and a thermometer to remove the solvents at 30° C. for 8 hours. Thereafter, the resultant is aged at 45° C. for 4 hours to obtain a liquid dispersion (slurry). 100 parts of the obtained slurry is filtered with a reduced pressure to obtain a cake material. 100 parts of deionized water is added to the cake material followed by mixing by a TK HOMOMIXER at a rotation number of 12,000 rpm for 10 minutes and filtration to obtain a cake material.

300 parts of deionized water is added to the cake material and the mixture is mixed by a TK HOMOMIXER at a rotation number of 12,000 rpm for 10 minutes and then filtered. This is repeated twice to obtain a cake material.

Next, 100 parts of deionized water is added to this cake material followed by mixing by a TK HOMOMIXER at a rotation number of 12,000 rpm for 10 minutes to obtain [Slurry 11].

The mixture of [Slurry 11] has a solid portion density of 15% and a slurry viscosity density of 5 cps.

The particle diameter of particles contained in [slurry 11] is measured by a Coulter Multisizer III (manufactured by Beckman Coulter Inc.) and the following is obtained. Dv: 3.92 μm; and Dv/Dn: 1.23.

Manufacturing of Slurry 12 (Mother Toner Particles Before Screening)

[Slurry 12] is prepared in the same manner as in those for [Slurry 11] except that the content of isophorone diamine is changed to 1.3 parts.

[Slurry 12] has a solid portion density of 15% and a slurry viscosity density of 5 cps.

The particle diameter of particles contained in [slurry 12] is measured by a Coulter Multisizer III (manufactured by Beckman Coulter Inc.) and has a volume average particle diameter (Dv) of 5.03 μm and a ratio (Dv/Dn) of 1.09.

Manufacturing of Slurry 13 (Mother Particles Before Screening)

[Slurry 13] is prepared in the same manner as in those for [Slurry 12] except that the content of BONTRON E-84 of [Slurry 12] is changed to 48 parts.

[Slurry 13] has a solid portion density of 15% and a slurry viscosity density of 8 cps.

The particle diameter of particles contained in [slurry 13] is measured by a Coulter Multisizer III (manufactured by Beckman Coulter Inc.) and has a volume average particle diameter (Dv) of 5.03 μm and a ratio (Dv/Dn) of 1.09.

With regard to [Slurry 13], the content of deionized water of the slurry is adjusted to prepare samples having different solid portion density. The details are shown in Table 3.

Manufacturing of Slurry 14 (Mother Toner Particles Before Screening)

[Slurry 14] is prepared in the same manner as in those for [Slurry 12] except that, in the emulsification for [Slurry 12], TK HOMOMIXER is rotated at 13,000 rpm for 20 minutes, which is changed to 10 minutes.

[Slurry 14] has a solid portion density of 15% and a slurry viscosity density of 6 cps.

The particle diameter of particles contained in [slurry 14] is measured by a Coulter Multisizer III (manufactured by Beckman Coulter Inc.) and has a volume average particle diameter (Dv) of 5.5 μm and a ratio (Dv/Dn) of 1.23.

Manufacturing of Slurry 15 (Mother Toner Particles Before Screening)

Preparation of Coloring Agent Liquid Dispersion 1

The following recipe is dissolved and dispersed using ULTRAVISCOMILL from AIMEX to prepare [Coloring agent liquid dispersion 1] in which a coloring agent (black pigment) is dispersed:

| | |
|---|---|
| Carbon black (PRINTEX 35, manufactured by Degussa Corporation) | 125 parts |
| AJISPER PB821 (manufactured by Ajinomoto Fine-Techno Co., Inc.) | 18.8 parts |
| Ethyl acetate (Special grade, manufactured by Wako Pure Chemical Industries, Ltd.) | 356.2 parts |

Preparation of Releasing Agent Liquid Dispersion

Preparation of Releasing Agent Liquid Dispersion 1 (Wax Component A)

The following recipe is wet-pulverized using ULTRAVISCOMILL from AIMEX to prepare Releasing agent liquid dispersion 1:

| | |
|---|---|
| Carnauba wax (melting point: 83° C., acid value: 8 mgKOH/g, saponification value: 80 mgKOH/g) | 30 parts |
| Ethyl acetate (Special grade, manufactured by Wako Pure Chemical Industries, Ltd.) | 270 parts |

The following recipe is wet-pulverized using ULTRAVISCOMILL from AIMEX to prepare Releasing agent liquid dispersion 1:

| | |
|---|---|
| Carnauba wax (melting point: 83° C., acid value: 8 mgKOH/g, saponification value: 80 mgKOH/g) | 30 parts |
| Ethyl acetate (Special grade, manufactured by Wako Pure Chemical Industries, Ltd.) | 270 parts |

The following recipe is wet-pulverized using ULTRAVISCOMILL from AIMEX to prepare [Form irregulation agent liquid dispersion 2]:

| | |
|---|---|
| BONTRON E-84 (manufactured by Orient Chemical Industries Co., Ltd.) | 50 parts |
| Ethyl acetate (Special grade, manufactured by Wako Pure Chemical Industries, Ltd.) | 270 parts |

The following recipe is mixed and stirred until uniformly mixed to prepare [Liquid E].

| | |
|---|---|
| Polyester (1) (Polyester resin, Mw: 50,000, Mn: 3,000, acid value: 15 mgKOH/g, hydroxyl value: 27 mgKOH/g, Tg: 55° C., softening point: 112° C., made of adduct of bisphenol A with ethylene oxide, adduct of bisphenol A of propylene oxide, and a terephtahlic acid derivative) | 350 parts |

-continued

| | |
|---|---|
| Coloring agent liquid dispersion 1 | 237 parts |
| Releasing agent liquid dispersion 1 | 72 parts |
| Form irregulation agent liquid dispersion 2 | 304 parts |
| Hydrophobic silicone particulates (R972, manufacture by NIPPON AEROSIL CO., LTD.) | 17.8 parts |

The following is stirred for 3 minutes using a T.K. HOMODISPER fmodel (manufactured by Primix Corporation) to prepare [Liquid F]:

| | |
|---|---|
| Calcium carbide in which 40 parts of calcium carbide particulates is dispersed in 60 parts of water | 100 parts |
| 1% aqueous solution of CELLOGEN BS-H, manufactured by Dai-ichi Kogyo Seiyaku Kogyo Co., Ltd. | |
| Water | 157 parts |

Next, 345 parts of [Liquid F] and 250 parts of [Liquid E] are stirred for 2 minutes using using T.K. HOMOMIXER mark2 fmodel (manufactured by Primix Corporation) at a rotation number of 10,000 rpm to obtain a suspension. The solvent is removed by stirring the suspension by a propeller type stirring device for 48 hours at room temperature and normal pressure. Then, hydrochloric acid is added to remove calcium carbide.

100 parts of the obtained slurry is filtered with a reduced pressure to obtain a cake material. 100 parts of deionized water is added to the cake material followed by mixing by a TK HOMOMIXER at a rotation number of 12,000 rpm for 10 minutes and filtration to obtain a cake material.

300 parts of deionized water is added to the cake material and the mixture is mixed by a TK HOMOMIXER at a rotation number of 12,000 rpm for 10 minutes and then filtered. This is repeated twice to obtain a cake material.

Next, 100 parts of deionized water is added to this cake material followed by mixing by a TK HOMOMIXER at a rotation number of 12,000 rpm for 10 minutes to obtain [Slurry 15].

The resultant ([Slurry 15]) has a solid portion density of 15% and a slurry viscosity density of 7 cps.

The particle diameter of particles contained in [slurry 15] is measured by a Coulter Multisizer III (manufactured by Beckman Coulter Inc.) and the following is obtained. Dv: 6.8 μm; and Dv/Dn: 1.15.

Example 10

[Slurry 11] is screened with a classifier which employs the structure illustrated in FIG. 1 with an opening size of 15 μm (material: polyester) and a total area of the screen of 3,140 $cm^2$.

Drying and Mixing

The cake obtained by filtering and separating the particulates through the screen is dried at 45° C. for 48 hours using a circulation drier to obtain [Mother toner particulate 5]. The charging of [Mother toner particulate 5] is shown in Table 3.

1.5 part of a hydrophobic silica (H2000, manufactured by Clariant) are admixed as an external additive with 100 parts of [Mother toner particulate 5] by a HENSCHEL MIXER (manufactured by Mitsui Mining Company, Limited) to manufacture [Toner 19] of Example 10. The evaluation results are shown in Tables 3-1 and 3-2.

Examples 11 to 19

[Slurry 12] to [Slurry 15] are screened under the conditions shown in Tables 3-1 and 3-2 to obtain [Mother toner particulate 6] to [Mother toner particulate 9] and thereafter the external additive is added to respective [Mother toner particulates] to obtain [Toner 20] to [Toner 28] of Examples 11 to 19 as in Example 10. The evaluation results thereof are shown in Tables 3-1 and 3-2. In Tables 3-1 and 3-2, ER therein represents the solid portion density of the slurry.

Comparative Example 10

[Slurry 13] is dried at 45° C. for 48 hours using a circulation drier to obtain [Mother toner particulate 10]. The charging of [Mother toner particulate 10] is shown in Tables 3-1 and 3-2.

1.5 part of a hydrophobic silica (H2000, manufactured by Clariant) are admixed as an external additive with 100 parts of [Mother toner particulate 10] by a HENSCHEL MIXER (manufactured by Mitsui Mining Company, Limited) followed by screening with ultrasonic vibration to prepare [Toner 29].

The screening conditions and the evaluation results are shown in Tables 3-1 and 3-2.

Comparative Example 11

[Slurry 12] is dried at 45° C. for 48 hours using a circulation drier to obtain [Mother toner particulate 11]. The charging of [Mother toner particulate 11] is shown in Tables 3-1 and 3-2.

1.5 part of a hydrophobic silica (H2000, manufactured by Clariant) are admixed as an external additive with 100 parts of [Mother toner particulate 11] by a HENSCHEL MIXER (manufactured by Mitsui Mining Company, Limited) followed by screening with ultrasonic vibration to prepare [Toner 30].

The screening conditions and the evaluation results are shown in Tables 3-1 and 3-2.

Comparative Example 12

[Slurry 13] is dried at 45° C. for 48 hours using a circulation drier to obtain [Mother toner particulate 12]. The charging of [Mother toner particulate 12] is shown in Tables 3-1 and 3-2.

1.5 part of a hydrophobic silica (H2000, manufactured by Clariant) are admixed as an external additive with 100 parts of [Mother toner particulate 12] by a HENSCHEL MIXER (manufactured by Mitsui Mining Company, Limited) followed by screening with a turbo screener (manufactured by Turbo Kogyo Co., Ltd.) to prepare [Toner 31].

The screening conditions and the evaluation results are shown in Tables 3-1 and 3-2.

Comparative Example 13

[Slurry 11] is dried at 45° C. for 48 hours using a circulation drier to obtain [Mother toner particulate 13]. The charging of [Mother toner particulate 13] is shown in Tables 3-1 and 3-2.

1.5 part of a hydrophobic silica (H2000, manufactured by Clariant) are admixed as an external additive with 100 parts of [Mother toner particulate 13] by a HENSCHEL MIXER (manufactured by Mitsui Mining Company, Limited) followed by screening with a turbo screener (manufactured by Turbo Kogyo Co., Ltd.) to prepare [Toner 32].

The screening conditions and the evaluation results are shown in Tables 3-1 and 3-2.

Comparative Example 14

[Slurry 15] is dried at 45° C. for 48 hours using a circulation drier to obtain [Mother toner particulate 14]. The charging of [Mother toner particulate 14] is shown in Tables 3-1 and 3-2.

1.5 part of a hydrophobic silica (H2000, manufactured by Clariant) are admixed as an external additive with 100 parts of [Mother toner particulate 14] by a HENSCHEL MIXER (manufactured by Mitsui Mining Company, Limited) followed by screening with a turbo screener (manufactured by Turbo Kogyo Co., Ltd.) to prepare [Toner 33].

The screening conditions and the evaluation results are shown in Tables 3-1 and 3-2.

Evaluation Method

Productivity

The amount of the toner passing through the screen per area unit thereof sis used as the index. Since the area of the screen is dependent on the device, the amount of toner passing through per 1 $m^2$ of the screen is used:

E (Excellent): 2 Kg/min or more

G (Good): 1.5 to less than 2.0 kg/min

F (Fair): 1 to less than 1.5 kg/min

B (Bad): less than 1 kg/min

White Spot (Hollow Defect)

Evaluation is made with regard to white spots according to the following procedure.

1. All the toners and the apparatuses for use in evaluation are left in an environment room (25° C. and 50% humidity) for one day.
2. Toner in the process cartridge unit (market product) of Imagio neo C600 is all removed and only carrier remains in the development device.
3. Sample toner is placed in the development device accommodating only carrier to prepare 400 g of development agent having a toner density of 7%.
4. The system is left in an environment of 27° C. and 80% RH for one day. After an image having a 5% chart is printed on 1,000 sheets, a solid image is output on 100 A3 sheets.
5. Whether white spots are found on the image is confirmed. The degree of occurrence of white spot is evaluated as follows:

E (Excellent): No white spots on 100 sheets.

G (Good): 1 to 3 white spots are found

F (Fair): 4 to 10 white spots are found

B (Bad): 10 or more white spots are found.

Measuring of Particle Diameter

The volume average particle diameter (Dv) and the number average particle diameter (Dn) of the toner manufactured by the present invention are measured by a particle size measuring device (Multisizer III, manufactured by Beckman Coulter Co., Ltd.) with an aperture of 100 μm and analyzed by an analysis software (Beckman Coulter Multisizer 3 Version 3.51). To be specific, 0.5 ml of 10 wt % surface active agent (alkylbenzene sulfonate SC-A, manufactured by Daiichi Kogyo Co., Ltd.) is placed in a glass beaker (100 ml). 0.5 g of each toner is added in the beaker and stirred by a microspatula. 80 ml of deionized water is added to the mixture and the thus obtained liquid dispersion is subject to dispersion treatment for 10 minutes by an ultrasonic wave dispersion device (W-113MK-II, manufactured by Honda Electronics).

The toner sample liquid dispersion is measured by the Multisizer III using ISOTON® III (manufactured by Beckman Coulter Inc.) as the measuring solution.

The toner sample liquid dispersion is dropped such that the density indicated by the measuring device is from 6 to 10%. In this measuring method, it is desired to keep the density in the range mentioned above in terms of measuring reproducibility. The measured particle size does not have an error when the density is in that range.

Charging of Mother Particle

Carrier of TEFV is placed in a cylinder having a diameter of 20 mm accommodating toner having a density of 5% and the mixture is stirred at 300 rpm for 20 minutes. The charging thereof is measured by using a charging measuring device manufactured by Kyocera Chemical Corporation.

TABLE 3-1

| | Toner | Slurry | Dv (μm) | Dv/Dn | ER | Viscosity (cps) | Charging of mother particle (μC) |
|---|---|---|---|---|---|---|---|
| Example 10 | 19 | 11 | 3.9 | 1.23 | 15 | 5 | −39 |
| Example 11 | 20 | 15 | 6.8 | 1.15 | 15 | 7 | −25 |
| Example 12 | 21 | 12 | 5 | 1.09 | 15 | 5 | −28 |
| Example 13 | 22 | 14 | 5.5 | 1.23 | 15 | 6 | −23 |
| Example 14 | 23 | 13 | 5.2 | 1.13 | 15 | 8 | −52 |
| Example 15 | 24 | 13 | 5.2 | 1.13 | 15 | 8 | −50 |
| Example 16 | 25 | 13 | 5.2 | 1.13 | 15 | 8 | −49 |
| Example 17 | 26 | 13 | 5.2 | 1.13 | 30 | 11 | −51 |
| Example 18 | 27 | 13 | 5.2 | 1.13 | 40 | 30 | −52 |
| Example 19 | 28 | 13 | 5.2 | 1.13 | 15 | 6 | −51 |
| Comparative Example 10 | 29 | 13 | 5.2 | 1.13 | 100 | — | −55 |
| Comparative Example 11 | 30 | 12 | 5 | 1.09 | 100 | — | −30 |
| Comparative Example 12 | 31 | 13 | 5.2 | 1.13 | 100 | — | −52 |
| Comparative Example 13 | 32 | 11 | 3.9 | 1.23 | 100 | — | −38 |
| Comparative Example 14 | 33 | 15 | 6.8 | 1.15 | 100 | — | −24 |

Dv and Dn are measeured for respective mother toner particulates.

TABLE 3-2

| | Toner | Screen material | Opening size (μm) | Device | Productivity | White spot | Evaluation |
|---|---|---|---|---|---|---|---|
| Example 10 | 19 | polyester | 15 | Shown in FIG. 1 | E | E | E |
| Example 11 | 20 | polyester | 15 | Shown in FIG. 1 | E | E | E |
| Example 12 | 21 | polyester | 15 | Shown in FIG. 1 | E | E | E |
| Example 13 | 22 | polyester | 15 | Shown in FIG. 1 | E | E | E |

TABLE 3-2-continued

| | Toner | Screen material | Opening size (μm) | Device | Productivity | White spot | Evaluation |
|---|---|---|---|---|---|---|---|
| Example 14 | 23 | nylon | 15 | Shown in FIG. 1 | E | G | G |
| Example 15 | 24 | polyester | 8 | Shown in FIG. 1 | F | E | G |
| Example 16 | 25 | polyester | 15 | Shown in FIG. 1 | E | E | E |
| Example 17 | 26 | polyester | 15 | Shown in FIG. 1 | G | E | G |
| Example 18 | 27 | polyester | 15 | Shown in FIG. 1 | F | E | F |
| Example 19 | 28 | polyester | 20 | Shown in FIG. 1 | E | E | E |
| Comparative Example 10 | 29 | metal | 65 | Ultrasonic vibration | B | B | B |
| Comparative Example 11 | 30 | metal | 65 | Ultrasonic vibration | B | B | B |
| Comparative Example 12 | 31 | polyester | 65 | Turbo screener | B | B | B |
| Comparative Example 13 | 32 | polyester | 65 | Turbo screener | B | B | B |
| Comparative Example 14 | 33 | polyester | 65 | Turbo screener | B | B | B |

This document claims priority and contains subject matter related to Japanese Patent Applications Nos. 2008-068885, 2008-068886 and 2008-058705, filed on Mar. 18, 2008, Mar. 18, 2008 and Mar. 7, 2008, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing a toner comprising:

granulating mother toner particles in an aqueous medium to obtain a slurry comprising the mother toner particles; and adjusting a size distribution of the mother toner particles by screening coarse mother toner particles from the slurry with a screen to obtain the toner comprising mother toner particulates, wherein the screen has a cylindrical form and is set in a fixed manner to remove the coarse mother toner particles in the mother toner particles by applying a centrifugal force to the slurry from an inside of the screen so that the slurry is caused to collide with the screen.

2. The method of manufacturing a toner according to claim 1, wherein the slurry is caused to collide with the screen to vibrate the screen so that the coarse mother toner particles are removed.

3. The method of manufacturing toner according to claim 1, wherein the screen having a cylindrical form is slanted.

4. The method of manufacturing a toner according to claim 1, wherein the screen satisfies a following relationship:

$$Dv\ (\mu m)\times 2 \leqq W\ (\mu m) \leqq Dv\ (\mu m)\times 4,$$

where Dv represents a weight average particle diameter of the mother toner particulates and W represents an opening size of the screen.

5. The method of manufacturing a toner according to claim 1, wherein the slurry has a solid portion having a density of from 10 to 40% by weight.

6. The method of manufacturing a toner according to claim 1, wherein the slurry has a viscosity of from 5 to 300 cps.

7. The method of manufacturing a toner according to claim 1, wherein the screen has an opening size of from 3 to 36 μm.

8. The method of manufacturing a toner according to claim 1, wherein the screen is a non-metal screen and has an amount of charge of from −20 to −60 μC/g.

9. The method of manufacturing a toner according to claim 8, wherein the non-metal screen is formed of polyester.

10. The method of manufacturing a toner according to claim 1, wherein the mother toner particulates have a weight average particle diameter Dv of from 3 to 7 μm.

11. The method of manufacturing a toner according to claim 10, wherein a ratio Dv/Dn of the weight average particle diameter Dv of the mother toner particulates to a number average particle diameter Dn thereof ranges from 1.05 to 1.25.

12. The method of manufacturing a toner according to claim 1, further comprising externally adding an external additive to the mother toner particulates.

13. The method of manufacturing a toner according to claim 1, wherein the slurry is caused to intermittently collide with the screen.

* * * * *